US005833428A

United States Patent [19]

Szinte

[11] Patent Number: 5,833,428

[45] Date of Patent: Nov. 10, 1998

[54] REFUSE RECEPTACLE COLLECTION ASSEMBLY

[75] Inventor: Zoltan Szinte, Des Plaines, Ill.

[73] Assignee: Kann Manufacturing Corporation, Iowa

[21] Appl. No.: 666,927

[22] Filed: Jun. 20, 1996

[51] Int. Cl.[6] ..... B65F 3/02

[52] U.S. Cl. ..... 414/408; 414/421; 414/550; 414/555

[58] Field of Search ..... 414/406, 408, 414/409, 420, 421, 487, 549, 550, 552, 553, 555

[56] References Cited

U.S. PATENT DOCUMENTS

| | | | |
|---|---|---|---|
| 2,906,419 | 9/1959 | Visco et al. . | |
| 3,016,157 | 1/1962 | Brisson . | |
| 3,083,849 | 4/1963 | Mottin . | |
| 3,136,436 | 6/1964 | Erlinder et al. . | |
| 3,148,793 | 9/1964 | Walter . | |
| 3,446,377 | 5/1969 | Heinert . | |
| 3,576,265 | 4/1971 | Brady et al. . | |
| 3,762,586 | 10/1973 | Updike, Jr. . | |
| 3,765,554 | 10/1973 | Morrison | 414/408 |
| 3,822,802 | 7/1974 | Evans, Jr. . | |
| 3,825,133 | 7/1974 | Owen, Jr. . | |
| 3,921,839 | 11/1975 | Herpich . | |
| 3,944,092 | 3/1976 | Ebeling et al. . | |
| 3,954,194 | 5/1976 | Stedman | 414/555 X |
| 4,042,137 | 8/1977 | Hughes et al. . | |
| 4,057,154 | 11/1977 | Neufeldt . | |
| 4,057,157 | 11/1977 | Park et al. . | |
| 4,175,903 | 11/1979 | Carson | 414/408 |
| 4,278,390 | 7/1981 | Ahearn . | |
| 4,363,588 | 12/1982 | Stickney . | |
| 4,401,407 | 8/1983 | Breckenridge . | |
| 4,461,608 | 7/1984 | Boda . | |
| 4,543,028 | 9/1985 | Bell et al. . | |
| 4,708,570 | 11/1987 | Smith et al. . | |
| 4,722,651 | 2/1988 | Antal | 414/555 X |
| 4,722,658 | 2/1988 | Würtz et al. . | |
| 4,726,726 | 2/1988 | Dossena et al. . | |
| 4,854,406 | 8/1989 | Appleton et al. . | |
| 4,915,570 | 4/1990 | Rath et al. | 414/409 |
| 4,936,732 | 6/1990 | Naab et al. . | |
| 4,983,092 | 1/1991 | Richards . | |
| 4,986,074 | 1/1991 | Hahmann et al. | 60/468 |
| 5,015,142 | 5/1991 | Carson | 414/408 |
| 5,035,563 | 7/1991 | Mezey | 414/409 |
| 5,064,332 | 11/1991 | Edelhoff et al. . | |
| 5,069,593 | 12/1991 | Zelinka et al. . | |
| 5,071,303 | 12/1991 | Carson | 414/21 |

(List continued on next page.)

FOREIGN PATENT DOCUMENTS

| | | | |
|---|---|---|---|
| 0 314 238 | 5/1989 | European Pat. Off. . | |
| 0 405 428 | 2/1991 | European Pat. Off. . | |
| 15 31 763 | 1/1970 | Germany . | |
| 35 37 546 | 4/1987 | Germany . | |
| 8001741 | 10/1981 | Netherlands . | |
| 9100231 | 1/1991 | WIPO | 414/408 |
| WO 93/15982 | 8/1993 | WIPO . | |

*Primary Examiner*—James W. Keenan
*Attorney, Agent, or Firm*—Foley & Lardner

[57] ABSTRACT

A refuse collection vehicle for collecting refuse contained in refuse receptacles includes a storage body having a plurality of segregated refuse compartments, an intermediate container having a plurality of bins corresponding to the plurality of refuse compartments, an intermediate container dumping assembly supported proximate the storage body for lifting and emptying contents of each of the plurality of bins into corresponding refuse compartments of the storage body and an automated refuse collection assembly supported adjacent the plurality of bins of the intermediate container. The automated refuse receptacle collection assembly is configured for engaging a refuse receptacle and is selectively movable so as to engage refuse receptacles curbside, streetside and anywhere in between the curbside and the streetside of the refuse collection vehicle. The automated refuse receptacle collection assembly is also configured and selectively movable for selectively dumping contents of the refuse receptacle into a selected one of the plurality of bins.

20 Claims, 13 Drawing Sheets

U.S. PATENT DOCUMENTS

| | | | |
|---|---|---|---|
| 5,122,025 | 6/1992 | Glomski | 414/486 |
| 5,163,805 | 11/1992 | Mezey | 414/786 |
| 5,176,488 | 1/1993 | Boda | 414/525.4 |
| 5,190,433 | 3/1993 | Boda | 414/525.1 |
| 5,192,031 | 3/1993 | Gilbert | 241/101.7 |
| 5,205,698 | 4/1993 | Mezey | 414/406 |
| 5,209,537 | 5/1993 | Smith et al. . | |
| 5,222,853 | 6/1993 | Carson | 414/408 |
| 5,266,000 | 11/1993 | LeBlanc, Jr. . | |
| 5,288,196 | 2/1994 | Horning et al. | 414/407 |
| 5,303,841 | 4/1994 | Mezey | 220/555 |
| 5,308,211 | 5/1994 | Bayne . | |
| 5,333,984 | 8/1994 | Bayne et al. . | |
| 5,335,958 | 8/1994 | Christenson et al. | 296/56 |
| 5,344,273 | 9/1994 | Radlein | 414/409 |
| 5,368,436 | 11/1994 | Freiburger | 414/786 |
| 5,375,960 | 12/1994 | Schiller | 414/406 |
| 5,391,039 | 2/1995 | Holtom . | |
| 5,419,671 | 5/1995 | Smith et al. . | |
| 5,458,452 | 10/1995 | Pellegrini | 414/406 |
| 5,470,187 | 11/1995 | Smith et al. . | |
| 5,482,180 | 1/1996 | Smith et al. . | |
| 5,484,245 | 1/1996 | Zopf | 414/408 |

REFUSE RECEPTACLE COLLECTION ASSEMBLY

BACKGROUND OF THE INVENTION

The present invention relates to refuse collection vehicles for hauling waste and recyclable commodities. In particular, the present invention relates to a refuse collection vehicle having a storage body, an intermediate container for being unloaded into the storage body and an automated refuse receptacle collection assembly for engaging a refuse receptacle and unloading contents of the refuse receptacle into the intermediate container. More particularly, the present invention relates to a refuse collection vehicle having a storage body with a plurality of refuse compartments, an intermediate container having a plurality of corresponding refuse bins actuable so as to unload into the plurality of corresponding compartments and an automated refuse receptacle collection assembly for engaging and unloading contents of a refuse receptacle into a selected bin of the intermediate container.

Residential refuse is typically contained in relatively small receptacles or containers such as cans or carts which are positioned along the street for pick-up by a refuse collection vehicle. Refuse collection vehicles generally include a storage body and a compactor for compacting refuse in the storage body. The refuse is either unloaded directly into the storage body or is unloaded into an intermediate container or "carry can" which, when full, is unloaded into the storage body.

Intermediate containers of refuse collection vehicles are typically loaded with refuse from the receptacles either manually or mechanically. Manual loading requires that an operator physically move, lift and tip the refuse receptacle over the intermediate container to unload refuse into the intermediate container. As a result, manual loading of an intermediate container is physically demanding and time consuming. Furthermore, manual loading of the intermediate container requires an operator to continuously board and unboard the refuse collection vehicle at each individual collection site. Consequently, manual loading of the intermediate container is tedious and time consuming.

Alternatively, the intermediate container may be mechanically loaded with refuse. Mechanical loading of the intermediate container is generally achieved using either a tipper or an automated collection assembly. With tippers, an operator must move the receptacle, typically a cart, into an aligned and engaged position with respect to the tipper. The tipper engages the receptacle and dumps the receptacle into the intermediate container for the operator. Although the tipper eliminates the need for the operator to lift and dump the receptacle into the intermediate container, the operator still must unboard the refuse collection vehicle to move the refuse receptacle into alignment, and possibly engagement, with the tipper.

In contrast to tippers which only lift and tilt the receptacle into the intermediate container, conventional automated collection assemblies additionally extend away from the intermediate container to engage refuse receptacles spaced from the intermediate container. For example, Zopf U.S. Pat. No. 5,484,245 discloses a side arm assembly including an extendable arm that linearly extends from a curbside of the intermediate container. Updike, Jr. U.S. Pat. No. 3,762,586 discloses a grab assembly that linearly extends forward of the intermediate container in front of the refuse collection vehicle. Because conventional collection assemblies can only extend in a single horizontal direction with respect to the intermediate container, conventional collection assemblies have an extremely limited range of motion. As a result, conventional automated collection assemblies require that the refuse collection vehicle itself be precisely positioned with respect to the refuse receptacle to align the collection assembly with the refuse receptacle for engagement. If the vehicle is not properly positioned with respect to the refuse receptacle, the vehicle must be repositioned or the operator must unboard the vehicle to physically reposition the refuse receptacle in alignment with the collection assembly. In addition, conventional collection assemblies are incapable of collecting receptacles positioned on multiple sides of the intermediate container and are specifically configured for use only with a correspondingly configured refuse receptacle. Consequently, conventional automated collection assemblies are inflexible as to both the positioning and the particular type of receptacle being used.

In recent years, communities and states have developed programs from the segregation and collection of recyclable materials to minimize consumption of natural resources and the exhaustion of landfills. As a result, the particular types of recyclable materials must be segregated from other types of recyclable materials and from non-recyclable materials. To enable a single refuse collection vehicle to be used for containing and transporting different types of recyclable commodities and non-recyclable refuse that must be segregated, both the storage body and the intermediate container of the refuse collection vehicle are provided with segregated compartments that receive an segregate different types of refuse or recyclable commodity.

Unfortunately, conventional tippers and conventional automated collection assemblies are incapable of selectively dumping refuse from a refuse receptacle into a selected compartment or bin of the intermediate container. As a result, refuse collection vehicles that include compartmentalized storage bodies and compartmentalized intermediate containers require manual loading of the intermediate container or require specific refuse receptacles specially configured to match the location and size of the individual bins of the intermediate container. As discussed above, manual loading of the intermediate container is physically demanding, tedious and time consuming. Alternatively, the use of specialized refuse receptacles increases the cost of refuse collection.

SUMMARY OF THE INVENTION

The present invention is a refuse collection vehicle for collecting refuse contained in refuse receptacles. The refuse collection vehicle includes a storage body, an intermediate container, an intermediate container dumping assembly supported proximate the storage body for lifting and emptying contents of the intermediate container into the storage body and an automated refuse receptacle collection assembly supported adjacent the intermediate container. In one embodiment, the automated refuse receptacle collection assembly includes a carriage assembly adjacent the intermediate container. The carriage assembly includes a track extending along the intermediate container, a carriage slidably supported along the track and a linear actuator for selectively moving the carriage along the track. The carriage supports a receptacle engaging assembly configured for engaging the refuse receptacle, a dumping assembly coupled to the receptacle engaging assembly for raising and dumping contents of the engaged refuse receptacle into the intermediate container and a pivot assembly supporting the dumping assembly and rotatably coupled to the carriage.

In a more preferred embodiment, the pivot assembly horizontally pivots receptacle engaging assembly and the receptacle dumping assembly approximately 180 degrees to enable the receptacle engaging assembly to engage refuse receptacles on both a streetside and a curbside, and the entire range in between, of the refuse collection vehicle. In addition, the carriage is preferably bi-directionally movable along the track so that the receptacle engaging assembly and the receptacle dumping assembly may be moved proximate to opposite sides of the intermediate container.

In another preferred embodiment, the receptacle engaging assembly includes a support coupled to the receptacle dumping assembly, first gripper arm pivotally coupled to a front of the support proximate a first end of the support, a second gripper arm pivotally coupled to the front of the support proximate a second opposite end of the support and means for selectively pivoting the first and second gripper arms. The second gripper arm is vertically spaced from the first gripper arm so that the first gripper arm and the second gripper arm may be pivoted adjacent and parallel to the support for compact storage.

In another embodiment of the present invention, the storage body of the refuse collection vehicle includes a plurality of segregated refuse compartments. The intermediate container includes a plurality of bins corresponding to the plurality of refuse compartments. The automated refuse receptacle collection assembly is supported adjacent the plurality of bins of the intermediate container. The automated refuse receptacle collection assembly is configured for engaging a refuse receptacle and is selectively movable so as to selectively dump contents of the refuse receptacle into a selected one of the plurality of bins.

DETAILED DESCRIPTION OF THE PREFERRED EMBODIMENTS

Throughout the specification of the application, various terms arc used such as "top", "bottom", "front", "rear" and the like. These terms denote directions with respect to the drawings and are not limitations of orientation of the present invention. Rather, these terms are provided for clarity in describing the relationship between members of the refuse collection vehicle.

I. OVERVIEW

Figure 1:
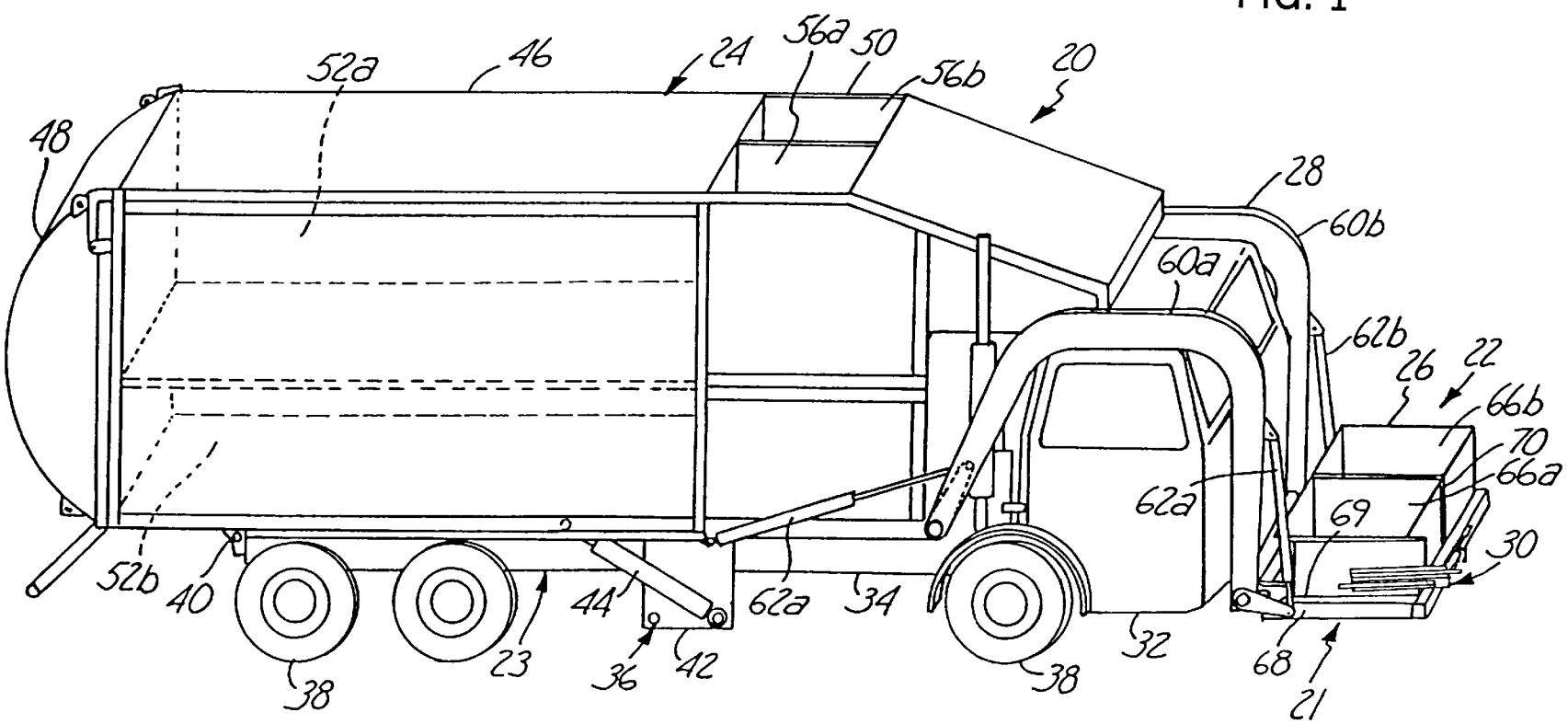
FIG. 1 is a perspective view of a refuse collection vehicle of the present invention.

FIG. 1 is a perspective view of refuse collection vehicle 20 having a curbside 21 and a streetside 22. Refuse collection vehicle 20 generally includes chassis 23, storage body 24, intermediate container 26, dumping assembly 28 and automated refuse receptacle collection assembly 30. Chassis 23 may have a variety of configurations depending upon the configurations of storage body 24, intermediate container 26 and dumping assembly 28. Chassis 23 supports and transports storage body 24, intermediate container 26 and intermediate container dumping assembly 28 between material pick-up and disposal sites. Chassis 23 further lifts and tilts storage body 24 and unloads refuse from storage body 24 and includes cab 32, frame 34, storage body tilting assembly 36 and wheels 38. Cab 32 is positioned forward of storage body 24 and rearward of intermediate container 26 and refuse receptacle collection assembly 30. Cab 32 houses an engine, a drive train and vehicle controls of vehicle 20. Frame 34 extends rearwardly from cab 32 and provides a base for supporting storage body 24. Preferably, frame 34 is pivotally coupled to storage body 24 at pivot 40.

Storage body tilting assembly 36 preferably is a hydraulic piston-cylinder assembly as is conventionally used for tipping or lifting storage bodies and grain and refuse vehicles. Tilting assembly 36 includes a hydraulic reservoir weldment or mount plate 42. The hydraulic cylinder assembly 44 is pivotally mounted between plate 42 and storage body 24. Actuation of cylinder assembly 44 lifts and tips storage body 24 near a front portion of frame 34 about pivot 40 so that refuse may be unloaded from a rear end of storage body 24. Alternatively, assembly 36 is mounted between frame 34 and a side of storage body 34 for tipping storage body 24 to one side to discharge refuse out a side discharge opening. As can be appreciated, tilting assembly 36 may alternatively employ pneumatic, mechanical, electrical or other linear actuating mechanisms to tilt storage body 24. Wheels 38 are rotatably mounted to frame 34 to support cab 32 and frame 34 above the ground.

Storage body 24 is mounted to and supported by frame 34 rearward of cab 32 which includes storage portion 46, tailgate assembly 48 and loading portion 50. Storage portion 46 extends between loading portion 50 and tailgate assembly 48. Storage portion 46 is preferably partitioned so as to define a plurality of segregated refuse compartments 52*a* and 52*b*. Each compartment is sized and configured for containing and segregating different types of refuse and commodity which require segregation from one another.

Compartments 52*a* and 52*b* of storage portion 46 hold refuse and commodity during transportation from a collection site to a disposal or recycling site.

Tailgate assembly 48, as conventionally known, closes and generally seals discharge openings of compartments 52*a*, 52*b*. Although illustrated as a bubble tailgate assembly, tailgate assembly 48 may alternatively comprise a variety of conventional alternative tailgate structures. Upon release and opening of tailgate assembly 48, refuse stored and contained within compartments 52*a*, 52*b*may be unloaded from storage body 24.

Loading portion 50 of storage body 24 is preferably positioned forward of storage portion 46 and includes loading chutes 56*a*, 56*b* and compactor assemblies (not shown). Loading chutes 56*a*, 56*b* comprise elongate generally vertical refuse passageways extending from the top of storage body 24 towards frame 34. Chutes 56*a*, 56*b* are segregated from one another and communicate with a distinct refuse compartment 52*a*, 52*b*within storage portion 46. As a result, refuse and commodity loaded into loading chutes 56*a*, 56*b* flows into corresponding refuse compartment 52*a*, 52*b* and remains segregated from refuse loaded into another loading chute 56.

A compactor assembly (not shown), as conventionally known, is preferably located within each loading chute 56*a*, 56*b* for moving refuse from each loading chute 56*a*, 56*b* into a corresponding compartment 52*a*, 56*b* and for compacting the refuse and commodity within each corresponding compartment 52*a*, 56*b*.

Intermediate container dumping assembly 28 lifts and empties contents of intermediate container 26 into storage body 24 and generally includes a pair of lifting arms 60*a*, 60*b* and corresponding power devices 62*a*, 62*b*. Arms 60*a*, 60*b* pivotally extend in front of cab 32 to engage and support intermediate container 26 forward of cab 32. Arms 60*a*, 60*b* are lifted by power devices 62*a*, 62*b*. Power devices 62 preferably comprise hydraulic piston/cylinder assemblies which are hydraulically controlled by control means within cab 32 as is conventionally known in the art. Power devices 62 lift arms 60*a*, 60*b* and intermediate container 26 upward and rearward of cab 32 to empty the contents of intermediate container 26 into storage body 24.

Intermediate container 26 is preferably supported between arms 60*a*, 60*b* of dumping assembly 28 and includes bins 66*a* and 66*b* and receptacle engaging assembly carrier 68. Bins 66*a* and 66*b* are sized and spaced apart from one another to match the size and location of loading chutes 56*a* and 56*b*, respectively. Although bins 66*a*, 66*b* are preferably connected together and supported as a single unitary structure that forms intermediate container 26, each bin 66*a* and 66*b* constitutes a separate and distinct refuse hold. Each bin 66*a* and 66*b* is sized as desired for sufficiently containing a selected type of refuse. Bins 66*a*, 66*b* are preferably spaced from one another by elongate slot 70 extending between each of bins 66*a*, 66*b*. As a result, once refuse is loaded into one of bins 66*a* and 66*b*, the refuse remains segregated from refuse contained in an adjacent bins. Bins 66*a* and 66*b* preferably are aligned in a row extending from the curbside to the streetside in front of cab 32.

To unload refuse from bins 66*a* and 66*b* into storage body 24, dumping assembly 28 lifts intermediate container 26 above and rearward of cab 32 so as to locate bins 66*a*, 66*b* above loading chutes 56*a*, 56*b*, respectively. Each loading chute 56*a*, 56*b* substantially receives its corresponding bin 66*a*, 66*b*. As a result, refuse contained within each of bins 66*a*, 66*b* is ensured of being deposited through a correct loading chute 56 into a correct storage compartment 52*a*, 56*b*.

Carrier 68 preferably extends along curbside 21 adjacent to bin 66*a* proximate a bottom of intermediate container 26. Carrier 68 provides a platform 69 for supporting refuse receptacle collection assembly 30 when refuse receptacle collection assembly 30 is not in use.

Refuse receptacle collection assembly 30 is supported adjacent bins 66*a* and 66*b* of intermediate container 26 and is configured for engaging a refuse container located either curbside or streetside or any position between. Refuse receptacle collection assembly 30 is selectively movable so as to selectively dump contents of the engaged refuse container into a selected one of bins 66*a*, 66*b* as desired. Refuse receptacle collection assembly 30 enables an operator, preferably within cab 32, to operate refuse receptacle collection assembly 30 to engage the receptacle, lift the receptacle off the ground, move the receptacle as necessary to sufficiently position the receptacle with respect to a selected one of bins 66*a*, 66*b*, and to further lift and tilt the engaged receptacle so as to unload the contents of the engaged receptacle into the selected one of bins 66*a*, 66*b*. As a result, receptacle collection assembly 30 enables the operator to more easily and more efficiently collect refuse contained in refuse receptacles.

II. INTERMEDIATE CONTAINER

Figure 2:
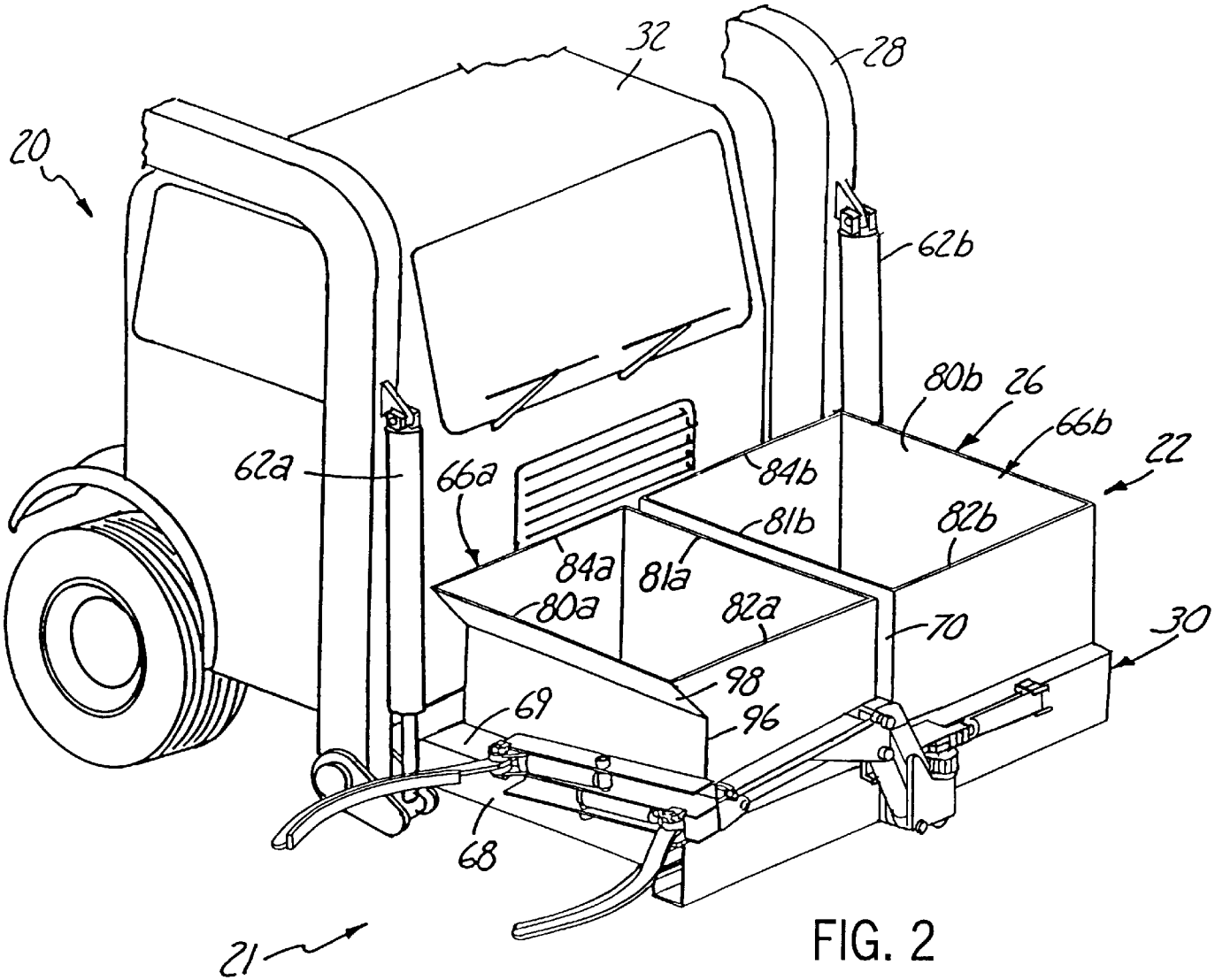
FIG. 2 is an enlarged perspective view of a front end of the refuse collection vehicle.
Figure 3:
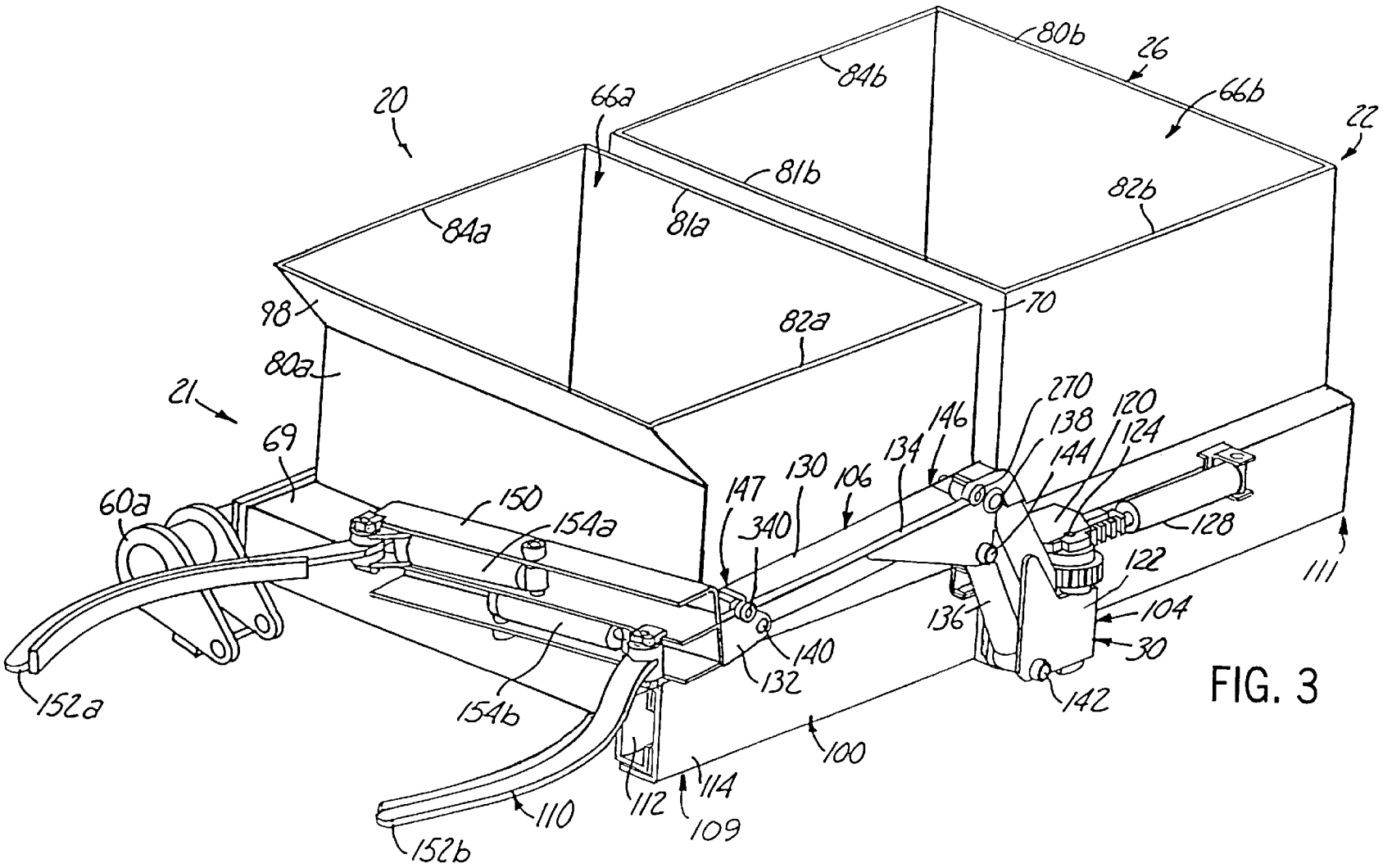
FIG. 3 is a perspective view of an intermediate container and a receptacle collection assembly of the refuse collection vehicle.

FIGS. 2 and 3 illustrate the front end of the refuse collection vehicle and intermediate container 26 in greater detail. For illustration purposes, intermediate container 26 and receptacle collection assembly 30 are illustrated in FIG. 3 as removed from intermediate container dumping assembly 28 shown in FIGS. 1 and 2. For case of illustration, those elements of FIG. 3 corresponding to elements of FIGS. 1 and 2 are numbered similarly, As best shown by FIGS. 2 and 3, each bin 66*a*, 66*b* has a pair of opposite sidewalls 80*a*, 80*b*, 81*a*, 81*b*, a front wall 82*a*, 82*b*, a rear wall 84*a*, 84*b* and a bottom 85 (shown in FIG. 11). Sidewalls 80*a* and 80*b* are preferably positioned curbside 21 and streetside 22, respectively. Sidewalls 81*a* and 81*b* are separated by slot 70. Sidewall 80*a* is configured for receiving and supporting refuse collection assembly 30. In particular, sidewall 80*a* of bin 66*a* preferably has a vertical portion 96 extending upward from platform 69 of carrier 68 and an angled portion that is angled outwardly towards curbside 21 to form lip 98. Lip 98 assists in funneling refuse into bin 66*a*. Platform 69, vertical portion 96 and lip 98 form a side-opening cavity for receiving automated receptacle collection assembly 30. Platform 69 further acts as a landing for temporarily supporting a receptacle collection assembly 30 when not in use. As a result, when not being used, automated receptacle collection assembly 30 may be positioned and stored in a compact non-obtrusive position to prevent automated receptacle collection assembly 30 from accidentally catching or engaging roadside and other obstructions.

III. RECEPTACLE COLLECTION ASSEMBLY

FIG. 3 further illustrates receptacle collection assembly 30 in greater detail. As shown by FIG. 3, automated refuse receptacle collection assembly 30 generally includes carriage assembly 100, pivot assembly 104, receptacle dumping assembly 106 and receptacle engaging assembly 110. Carriage assembly 100 generally includes track 112, carriage 114 and a linear actuator assembly 116 (shown in FIG. 4). Track 112 is fixedly coupled to intermediate container 26 and extends along a front end of intermediate container 26. Track 112 preferably extends from streetside 22 to curbside 21 of intermediate container 26. Track 112 preferably projects past sidewall 80*a* of bin 66*a* so that carriage 114 may also project further outward towards curbside 21. Track 112 is preferably located towards a lower end of intermediate container 26 so that bins 66 may be extended into loading chutes 56 when intermediate container 26 is inverted by container dumping assembly 28 (shown in FIG. 1). Track 112 movably supports carriage 114 adjacent intermediate container 26 and guides movement of carriage 114 of intermediate container 26 between curbside 21 and streetside 22.

Carriage 114 is movably coupled to track 112 as to move along track 112 between streetside 22 and curbside 21. Carriage 114 is bi-directionally movable along track 112 so that dumping assembly 106 and receptacle engaging assembly 110 may be positioned proximate to both curbside 21 and streetside 22 of intermediate container 26 and may be extended away from intermediate container 26 on both curbside 21 and streetside 22. Carriage 114 supports dumping assembly 106 and receptacle engaging assembly 110 adjacent intermediate container 26 and along track 112. Linear actuator assembly 116 (shown in FIG. 4) selectively moves carriage 114 along track 112 so as to selectively position receptacle dumping assembly 106 and receptacle engaging assembly 110 proximate to either curbside 21 or streetside 22.

Pivot assembly 104 is coupled to carriage 114 intermediate ends 109, 111 in front of carriage 114 at a forward most end of intermediate container 26. Pivot assembly 104 generally includes carriage mount 120, boom assembly 122, spindle 124 and rotary actuator 128. Carriage mount 120 is fixedly coupled to carriage 114 and projects from carriage 114 for rotatably supporting boom assembly 122 in front of carriage 114 with spindle 124. Spindle 124 has an end fixedly secured to carriage mount 120 and extends through boom assembly 122 to rotatably support boom assembly 122 with roller bearings as are conventionally known. Rotary actuator 128 rotates or pivots boom assembly 122 about an axis of spindle 124 to pivot boom assembly 122 so that boom assembly 122 may be selectively extended towards both curbside 21 and streetside 22 in front of intermediate container 26.

Receptacle dumping assembly 106 extends from boom assembly 122 for supporting, lifting and tipping receptacle engaging assembly 110. Receptacle dumping assembly 106 generally includes arm 130, kicker 132, link 134, actuator 136 and pins 138, 140, 142 and 144. Arm 130 extends between boom assembly 122 and kicker 132 to support kicker 132 adjacent sidewall 80*a* of bin 66*a*. Arm 130 has a first end 146 pivotally coupled to boom assembly 122 by pin 138 and a second end 147 pivotally coupled to kicker 132 by pin 140.

Kicker 132 is coupled to end 147 of arm 130 by pin 140. Kicker 132 preferably extends perpendicular to arm 130 to provide dumping assembly 106 with a generally L-shaped configuration. Kicker 132 is fixedly coupled to receptacle engaging assembly 110. Kicker 132 supports receptacle engaging assembly 110 generally perpendicular to arm 130. As a result, receptacle engaging assembly 110 may be positioned so as to face curbside for engaging a curbside refuse receptacle adjacent sidewall 80*a* of bin 66*a*. Because dumping assembly 106 is generally L-shaped so as to extend along the front wall 82 and sidewall 80*a* of bin 66*a*, projection of dumping assembly 106 away from intermediate container 26 is minimized to minimize the possibility of dumping assembly 130 accidentally catching upon roadside obstructions.

Link 134 extends between kicker 132 and boom assembly 122. Link 134 is preferably pivotally coupled to both kicker 132 and boom assembly 122 about bosses 340 and 270, respectively. Link 134 supports kicker 132 and receptacle engaging assembly 110 in a generally horizontal orientation when arm 130 is supported in a similar horizontal orientation. Link 134 fixes a distance between kicker 132 and boom assembly 122 so that actuation of actuator 136 causes kicker 132 to pivot about pin 140 as arm 130 is rotated about pin 138. Actuator 136 is pivotally coupled between boom assembly 122 and first end 146 of arm 130 by pins 142 and 144, respectively. Actuator 136 preferably comprises a linear actuator, such as a hydraulic cylinder assembly. Actuation of actuator 136 pivots arm 130 about an axis of pin 138. For example, extension of actuator 136 rotates arm 130 about the axis of pin 138 in a clockwise direction to raise receptacle engaging assembly 110. Likewise, retraction of actuator 136 rotates arm 130 in a counterclockwise direction to lower receptacle engaging assembly 110. Because link 134 fixes the distance between boom assembly 122 and kicker 132, rotation of arm 130 about the axis of pin 138 causes kicker 132 to rotate about an axis of pin 140 in a corresponding direction. As a result, extension of actuator 136 to rotate arm 130 about the axis of pin 138 also causes kicker 132 to rotate clockwise about the axis of pin 140 to additionally tilt receptacle engaging assembly 110 for unloading contents of an engaged receptacle. Actuator 136 rotates receptacle engaging assembly 110 and the engaged receptacle in a generally vertical plane to tip the refuse receptacle for unloading contents of the refuse receptacle into bin 66 of intermediate container 26.

Receptacle engaging assembly 110 extends from a frontside of kicker 132 for engaging refuse receptacles. Receptacle engaging assembly 110 generally includes support 150, gripper arms 152*a*, 152*b* and actuators 154*a*, 154*b*. Support 150 is fixedly mounted to kicker 132 parallel to kicker 132 and supports gripper arms 152*a*, 152*b* and actuators 154*a*, 154*b*. Gripper arms 152*a*, 152*b* are pivotally coupled to a frontside of support 150 and are vertically spaced from one another enabling grip arms 152*a*, 152*b* to substantially encircle and engage a variety of differently sized refuse receptacles. Actuators 154*a*, 154*b* are preferably linear actuators, such as hydraulic cylinder assemblies, that are coupled between the port 150 and arms 152*a*, 152*b*, respectively. Actuation of actuators 154*a*, 154*b* selectively pivots arms 152*a*, 152*b* towards and away from one another for selectively engaging and releasing a refuse receptacle.

A. CARRIAGE ASSEMBLY

Figure 4:
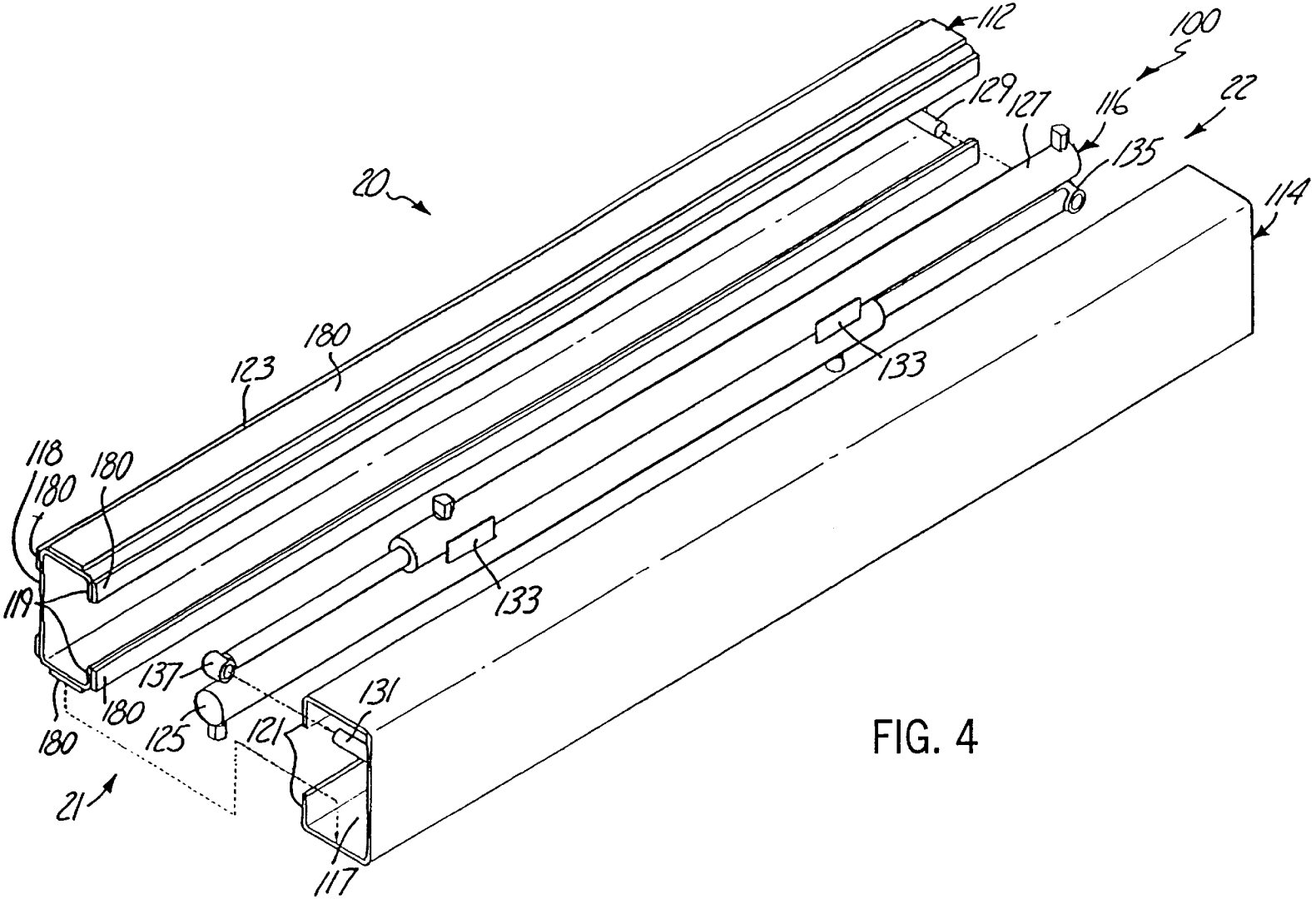
FIG. 4 is an exploded perspective view of a carriage assembly of the refuse collection assembly.

FIG. 4 is an exploded perspective view illustrating track 112, carriage 114 and linear actuator assembly 116 of carriage assembly 100 in greater detail. As best shown by FIG. 4, track 112 is an elongate C-shaped member for being slidably received by carriage 114 and for housing linear actuator assembly 116. Track 112 includes a rear surface 118 and inwardly bent ends 119. Rear surface 118 extends opposite ends 119 and is configured for being fixedly mounted to intermediate container 26. Ends 119 are preferably spaced from one another a sufficient distance for permitting actuator assembly 116 to be securely mounted between track 112 and carriage 114 and to move with the movement of carriage 114 between ends 119 along the length of track 112. Track 112 includes an exterior surface 123 having low static and dynamic coefficients of friction to facilitate sliding movement of carriage 114 within chamber 117 of track 112. Preferably, surface 123 is formed by riveting or otherwise fixedly coupling strips 180 of wear resistant material having low coefficients of friction, such as plastic or bronze, to track 112. Alternatively, surface 123 may be laminated, sprayed or otherwise coated on an exterior surface of track 112 for wear and reduced frictional resistance.

Carriage 114 is preferably an elongate member having a C-shaped cross-section. Carriage 114 is preferably sized so as to fit about surface 123 of track 112. Preferably, carriage 114 is sized in close tolerance with track 112 to produce steady movement of carriage 114. Carriage 114 includes inwardly bent ends 121 for maintaining carriage 114 about track 112. Ends 121 are preferably spaced apart from one another to permit actuator assembly 116 to be coupled between track 112 and carriage 114. Because carriage 114 partially encloses and engages all sides of track 112, track 112 steadily and reliably guides movement of carriage 114 to steadily move pivot assembly 104, receptacle dumping assembly 106 and receptacle engaging assembly 110 (shown in FIG. 4).

Linear actuator assembly 116 includes linear actuator 125, linear actuator 127, pins 129, 131 and actuator coupling members 133. Linear actuator 125 preferably comprises a hydraulic cylinder assembly having a rod 135 fixedly coupled to track 112 by pin 129. Linear actuator 127 preferably comprises a hydraulic cylinder assembly positioned adjacent linear actuator 125 and having a rod 137 fixedly coupled to carriage 114 by pin 131.

Actuator coupling members 133 fixedly couple actuators 125 and 127 together. Actuator coupling members 133 preferably comprise metal blocks which secure linear actuators 125 and 127 together, preferably by welding. As a result, selective extension and retraction of rods 135 and 137 of actuators 125 and 127, respectively, moves carriage 114 within track 112 towards curbside 21 or towards streetside 22. In particular, because rod 135 of actuator 125 is fixedly coupled to track 112 by pin 129, extension of rod 135 moves carriage 114 towards the curbside 21 of track 112. Extension of rod 137 moves carriage 114 further towards the curbside 21. Because actuator 125 is fixedly coupled to actuator 127 by coupling members 133 and because rod 137 is fixedly coupled to carriage 114 by pin 131, retraction of rod 137 moves carriage 114 towards streetside 22 of track 112. Retraction of rod 137 further moves carriage 114 towards streetside 22. Because linear actuator assembly 116 includes two individual linear actuators fixedly coupled together and having a single end coupled to either track 112 or carriage 114, linear actuator assembly 116 is bi-directional and is capable of extending carriage 114 farther outward away from track 112 towards either the curbside 21 or the streetside 22.

As can be appreciated, carriage assembly 100 may have a variety of alternative structures and linear actuating mechanisms for moving carriage 114 along track 112. For example, carriage 114 may alternatively comprise a telescopic bar or cylinder. Furthermore, in lieu of linear actuator assembly 116, movement of carriage 114 may be implemented by a rack and pinion with a hydraulic or electric motor, a chain powered by a pair of spaced apart sprockets and coupled to the carriage, or a hydraulic cylinder in combination with a chain for moving carriage 114 relative to track 112.

B. PIVOT ASSEMBLY

Figure 5:
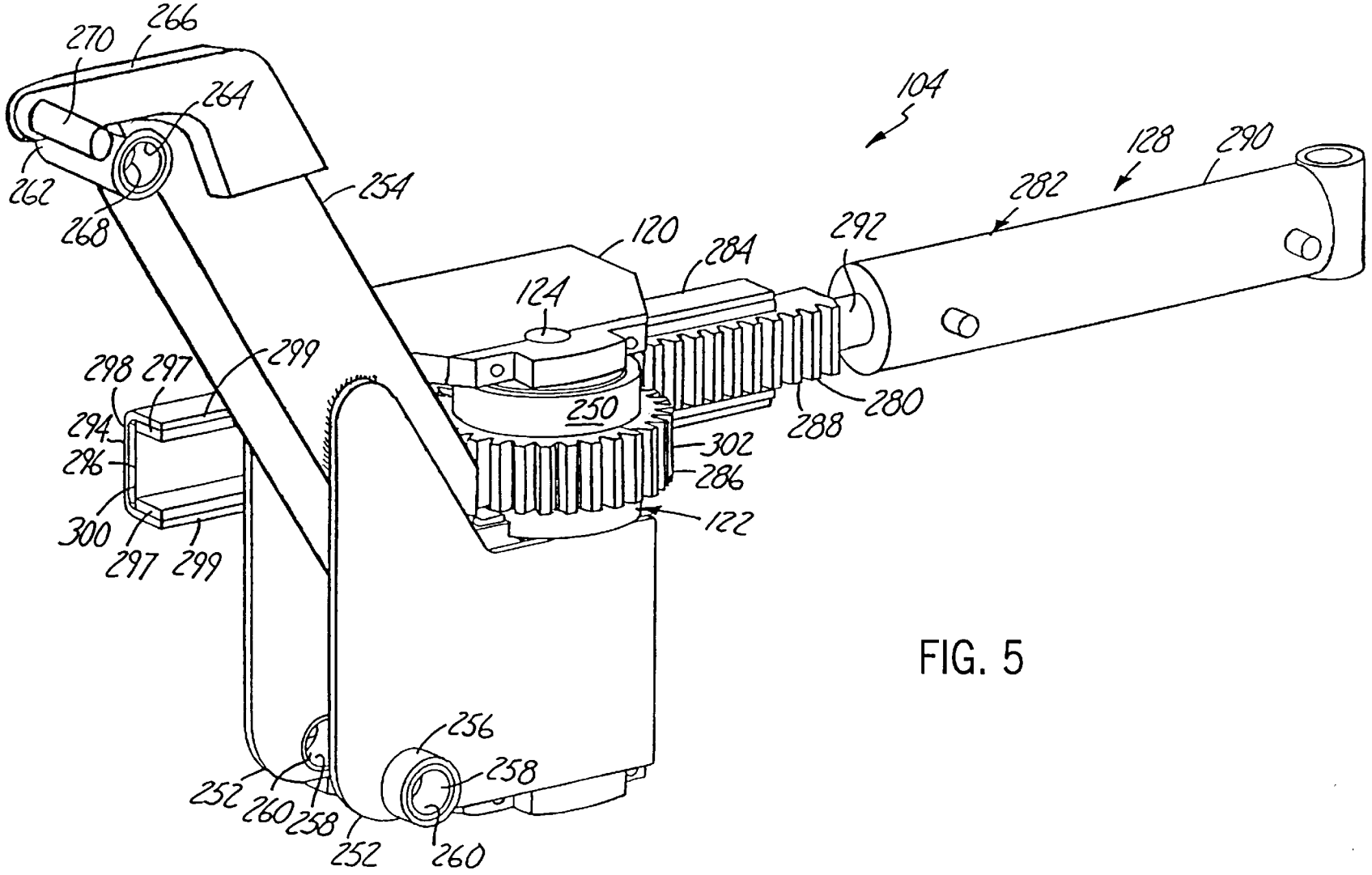
FIG. 5 is an enlarged perspective view of a pivot assembly of the refuse collection assembly.

FIG. 5 is an enlarged perspective view of pivot assembly 104 illustrating carriage mount 120, boom assembly 122, spindle 124 and rotary actuator 128 in greater detail. For ease of illustration, pivot assembly 104 is illustrated as being removed from carriage assembly 100 (shown in FIG. 3). As best shown by FIG. 5, carriage mount 120 preferably comprises a generally flat horizontal plate configured for being fixedly mounted to carriage 114 of carriage assembly 100 (shown in FIG. 3). Carriage mount 120 secures pivot assembly 104 to carriage 114 (shown in FIG. 3).

Boom assembly 122 is rotatably coupled to carriage mount 120 by spindle 124 and includes hub 250, gussets 252 and boom 254. Hub 250 is a generally cylindrical shaped member encircling spindle 124. Hub 250 is rotatably supported about spindle 124 by a conventional ball or roller bearing assembly (not shown). Gussets 252 are generally flat, rigid plates fixedly coupled to hub 250 and boom 254, preferably by welding, on opposite sides of hub 250 and boom 254. Gussets 252 each include an outward extending boss 256 which receives a bushing 258. Bushing 258 defines a pair of aligned openings 260 for receiving pin 144 (shown in FIG. 3) to pivotally support actuator 136 of receptacle dumping assembly 106.

Boom 254 is an elongate support member extending from hub 250 and from gussets 252 at an angle of approximately 45 degrees with respect to the horizontal. Boom 254 is preferably welded to gussets 252 and hub 250 for strength and rigidity. Boom 254 includes boss 262, bushing 264 and link support 266. Boss 262 is a generally tubular shaped member fixedly coupled to or integrally formed as part of boom 254 and sized for receiving bushing 264. Bushing 264 is preferably made from aluminum or bronze and is fit within boss 262. Bushing 264 defines an opening 268 for receiving pin 138 to pivotally support end 146 of arm 130 (shown in FIG. 3).

Link support 266 projects outwardly from boom 254 and is configured for being rotatably coupled to link 134 of receptacle dumping assembly 106 (shown in FIG. 3). Link support 266 preferably includes a boss 270 which mates with link 134 for supporting link 134 of receptacle dumping assembly 106.

Rotary actuator 128 rotates boom assembly 122 about spindle 124 so as to rotate receptacle dumping assembly 106 and receptacle engaging assembly 110 in a generally horizontal plane proximate intermediate container 26. Rotary actuator 128 generally includes rack gear 280, linear actuator 282, slide assembly 284 and spur gear 286. Rack gear 280 is an elongate rack having teeth 288 for engaging spur gear 286. Rack gear 280 is moved with respect to spur gear 286 by linear actuator 282.

Linear actuator 282 preferably comprises a hydraulic cylinder assembly having a cylinder 290 and a rod 292. Cylinder 290 is fixedly coupled to a stationary member, preferably carriage 114 (shown in FIG. 3). Rod 292 is actuable with respect to cylinder 290 and is fixedly coupled to rack gear 280. Selective actuation of linear actuator 282 linearly moves rack gear 280 relative to spur gear 286. As can be appreciated, a variety of other well-known linear actuators such as solenoids, pneumatic cylinder assemblies and other mechanical or electric mechanisms may be used to linearly reciprocate rack gear 280 relative to spur gear 286.

Slide assembly 284 slides and steadies the reciprocal movement of rack gear 280 with respect to spur gear 286 and includes slide 294 and wear strips 296, 297. Slide 294 is an elongate rigid member having a central portion 298 and angled ends 299. Ends 299 extend at approximately 90 degrees with respect to central portion 298 to provide slide 294 which has a generally U-shaped cross-section. Wear strip 296 extends along the length of central portion 298 of slide 294 between ends 299. Wear strip 296 is preferably formed from a rigid, wear resistant material such as aluminum or bronze. Wear strips 297 extend along the length of slide 294 adjacent ends 299. Wear strips 297 face one another and are preferably formed from a wear resistant material having low coefficients of friction, such as a plastic material. Wear strips 296 and 297 are supported by slide 294 and define an elongate slot or channel 300 sized for slidably receiving rack gear 280. Wear strip 296 contacts a backside of rack gear 280 opposite teeth 288 while wear strips 297 engage side edges of rack gear 280 to steadily guide the reciprocal movement of rack gear 280 relative to spur gear 286. Central portion 298 of slide 294 is preferably fixedly coupled to carriage 114 (shown in FIG. 3). As can be appreciated, wear strips 296 and 297 may be omitted and replaced with coatings or laminants of wear resistant, low friction materials applied to convex surfaces of slide 294. As can further be appreciated, a variety of alternative support structures may be used for guiding movement of rack gear 280 with respect to spur gear 286.

Spur gear 286 comprises a conventional spur gear having teeth 302 at least partially surrounding hub 250 and in mutual engagement with teeth 288 of rack gear 280. Spur gear 286 is fixedly coupled to hub 250 so that rotation of spur gear 286 correspondingly rotates hub 250 of boom assembly 122.

Rotary actuator 128 pivots or rotates boom assembly 122 about spindle 124 to pivot or rotate receptacle dumping assembly 106 and receptacle engaging assembly 110 in a generally horizontal plane so that receptacle engaging assembly 110 may engage containers through an area of greater than 180 degrees in front of intermediate container 26 (shown in FIG. 3). In particular, linear actuator 282 moves rack gear 280 linearly with respect to spur gear 286. Teeth 288 of rack gear 280 engage teeth 302 of spur gear 286 to rotate spur gear 286 and hub 250 about spindle 124. By selectively controlling the extension or retraction of rack gear 280 with respect to spur gear 286, an operator may select the precise rotational position of receptacle engaging assembly 110 with respect to intermediate container 26. As can be appreciated, in lieu of linear actuator 282 moving rack gear 280 with respect to spur gear 286 to pivot or rotate boom assembly 122 about spindle 124, a variety of other well-known rotary actuators may be used such as a hydraulic cylinder with a bell crank, a sprocket driven by a electric or a hydraulic motor, a hydraulic rotary actuator, a worm gear with a motor or a spur gear with a pinion driven by a motor.

C. RECEPTACLE DUMPING ASSEMBLY

Figure 6:
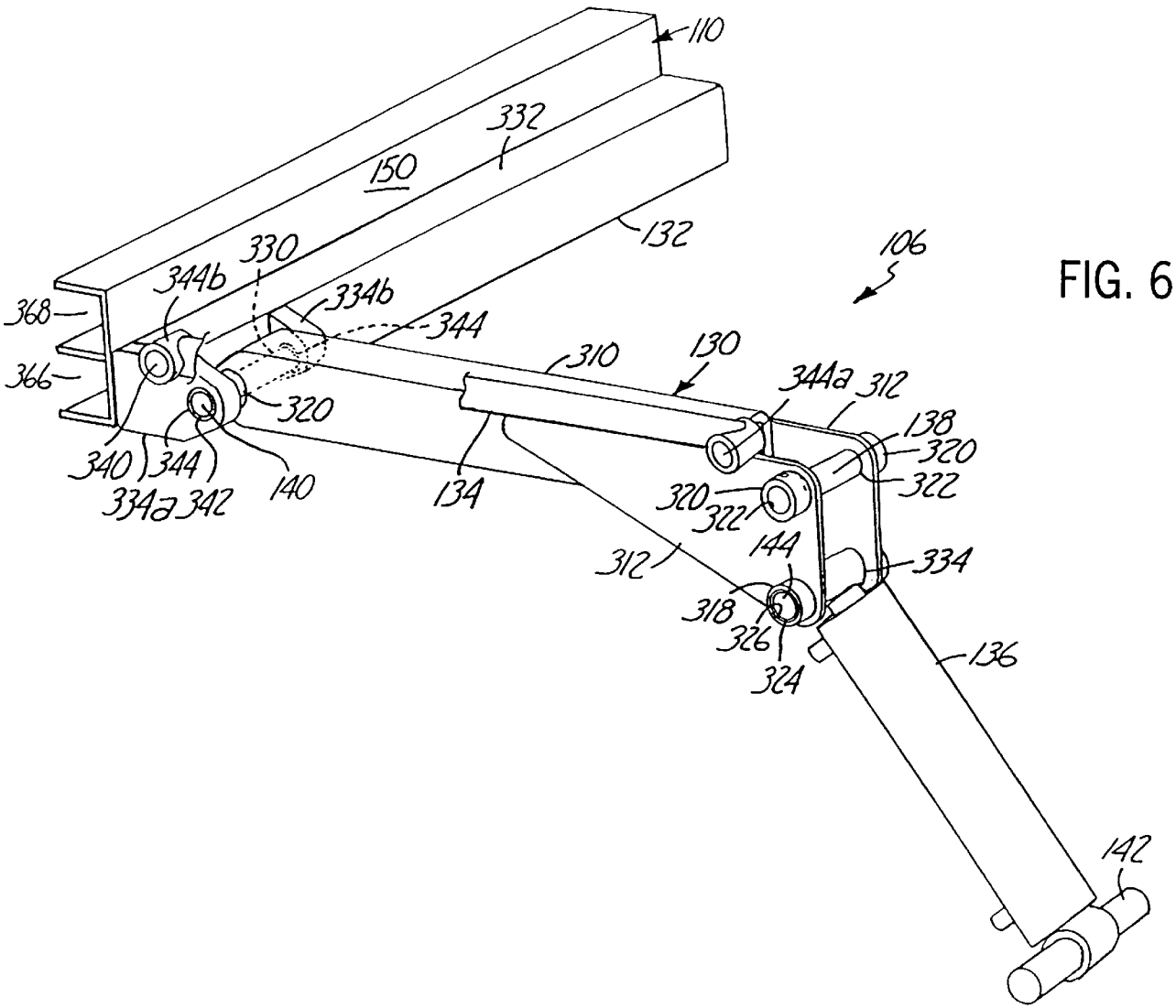
FIG. 6 is an enlarged perspective view of a receptacle dumping assembly of the receptacle collection assembly.

FIG. 6 is a perspective view of receptacle dumping assembly 106 illustrating arm 130, kicker 132 and link 134 of arm assembly 130 in greater detail. For ease of illustration, receptacle dumping assembly 106 is shown as being disconnected from pivot assembly 104 and is shown as attached to support 150 of receptacle engaging assembly 110. As best shown by FIG. 6, arm 130 includes bar 310, gussets 312 and retaining collars 318, 320. Bar 310 of arm 130 is an elongate rigid member preferably having a sufficient length so as to extend to the curbside of intermediate container 26 (shown in FIG. 3) for supporting kicker 132 adjacent sidewall 80 of intermediate container 26.

Gussets 312 are fixedly coupled to bar 310, preferably by welding, on opposite sides of bar 310. Gussets 312 are sufficiently spaced apart from one another for receiving boss 262 of boom 254 (shown in FIG. 5). Collars 318, 320 are welded to gussets 312. Collars 318 are fixedly coupled by welding on opposite sides of gussets 312 and have bores sized for receiving bushings 324. Bushings 324 define a pair of aligned openings 326 sized for receiving pin 144. Pin 144 is journaled within openings 326 and spans between both gussets 312. Pin 144 extends through an eye of actuator 136 to couple arm 130 to actuator 136. Retaining collars 318 secure pin 144 in place.

Collars 320 are fixedly coupled by welding to opposite sides of gusset 312. Collars 320 define bores 322 for receiving pin 138. Pin 138 is journaled across gussets 312 through openings 322 and through opening 268 of boom 254 (shown in FIG. 5) to pivotally couple arm 130 to an upper end of boom 254 (shown in FIG. 5). Retaining collars 320 secure pin 138 in place.

Kicker 132 is pivotally coupled to arm 130 and extends from arm 130 at approximately 90 degrees to provide dumping assembly 106 with a generally L-shaped configuration. Kicker 132 includes body 332, ears 334*a*, 334*b* and boss 340. Body 332 of kicker 132 is an elongate bar having a length sufficient for supporting receptacle engaging assembly 110. Ears 334*a* and 334*b* extend from body 332 and are spaced apart from one another for receiving an end of bar 310 of arm 130. Ears 334*a* and 334*b* include a pair of aligned apertures 342 sized for receiving bushings 344. Bushings 344 are sized for receiving pin 140. Pin 140 extends through bushings 344 and through bore 330 of bar 310 to pivotally couple kicker 132 to arm 130. Boss 340 extends from ear 334*a* and is configured for engaging one end of link 134.

Link 134 is a generally cylindrical rod having eyelets 344*a*, 344*b* at opposite ends. Eyelet 344*a* of link 134 is sized to receive boss 270 of boom 254 (shown in FIG. 5) while eyelet 344*b* is sized to receive boss 340 of kicker 132. Upon being mounted between bosses 340 and 270 of kicker 132 and boom 254, link 134 directly joins or links kicker 132 to boom 254. As a result, boom 254 and link 134 support kicker 132 relative to arm 130. During rotation of arm 130 about pin 138 by extension of actuator 136, kicker 132 is also rotated and extended away from boom 254. Consequently, during extension of actuator 136, kicker 132 must rotate about the axis of pin 140 in a clockwise direction. The additional rotation of kicker 132 by link 134 during rotation of arm 130 facilitates additional tipping of the refuse receptacle engaged by receptacle engaging assembly 110 (shown in FIG. 3) which is supported by kicker 132. As a result, refuse within the refuse receptacle is more easily unloaded from the refuse receptacle into intermediate container 26.

D. RECEPTACLE ENGAGING ASSEMBLY

Figure 7:
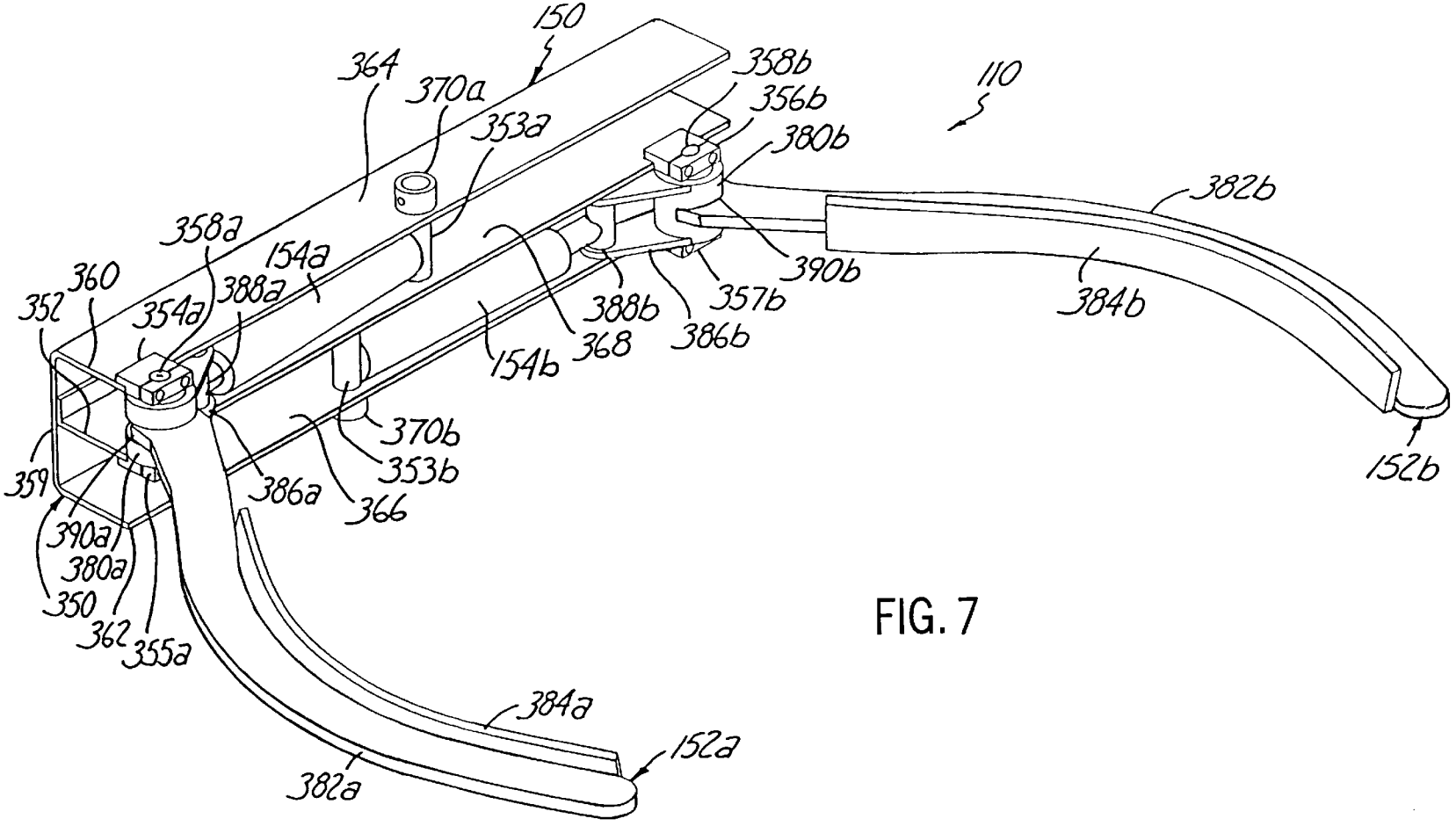
FIG. 7 is an enlarged perspective view of a receptacle engaging assembly of the refuse receptacle collection assembly.

FIG. 7 is an enlarged perspective view of receptacle engaging assembly 110 illustrating support 150, gripper arms 152*a*, 152*b* and actuators 154*a*, 154*b* in greater detail. For ease of illustration, receptacle engaging assembly 110 is illustrated as being separated from kicker 132. As best shown by FIG. 7, support 150 includes channel frame 350, angle 352, hub mounts 354*a*, 355*a*, 356*b*, 357*b* and spindles 358*a*, 358*b*. Channel frame 350 is an elongate trough shaped member having a back central portion 359 and a pair of inwardly angled end portions 360, 362. Central portion 359 is generally flat and is configured for being mounted to body 332 of kicker 132 (shown in FIG. 6) by conventional mounting methods such as welding, bolting, riveting and the like. End portions 360 and 362 form an upper platform 364 and a lower platform 366 for supporting hub mounts 354*a* and 357*b*.

Angle 352 is a generally L-shaped member fixedly coupled to central portion 358 between end portion 360 and 362 of channel frame 350 to provide an intermediate platform 368 for supporting hub mounts 355*a* and 356*b*. Pins 353*a* and 353*b* are positioned for stationarily supporting one end of actuators 154*a* and 154*b*, respectively. Pin 353*a* is fixedly coupled between upper platform 364 and intermediate platform 368. Preferably, pin 353*a* extends through both platform 364 and 368 and is supported in place by a retaining collar 370*a* fixedly coupled to platform 364 by welding. Pin 353*b* is fixedly coupled to and between platforms 366 and 368. Preferably, pin 353*b* extends through both platforms 366 and 368 and is fixed in place by retaining collar 370*b* fixedly coupled to platform 366 by welding.

Hub mounts 354*a*, 355*a* support spindle 358*a* to which arm 152*a* is rotatably coupled. Hub mount 354*a* is fixedly coupled, preferably by welding, to upper platform 364. Hub mount 355*a* is fixedly mounted, preferably by welding, to intermediate platform 368. Hub mounts 354*a* and 355*a* are aligned with one another to fixedly receive spindle 358*a* and to support spindle 358*a* between platform 364 and 368.

Hub mount 356*b* is fixedly mounted to intermediate platform 368. Hub mount 357*b* is fixedly coupled to lower platform 366. Hub mount 356*b* and 357*b* are aligned with one another for fixedly supporting spindle 358*b* between platform 366 and 368. Hub mounts 354*a*, 355*b*, 356*b* and 357*b* are conventionally known.

Spindles 358*a* and 358*b* extend between hub mounts 354*a*, 355*a* and hub mounts 356*b*, 357*b*, respectively. Spindles 358*a* and 358*b* extend through arms 152*a* and 152*b*, respectively. Spindles 358*a* and 358*b* provide an axis about which arms 152*a* and 152*b*, respectively, pivot or rotate so as to engage a refuse receptacle.

Gripper arms 152*a*, 152*b* are pivotally coupled to support 150 about spindles 358*a*, 358*b* and extend from a front surface of support 150 opposite central portion 359 which is attached to kicker 132 (shown in FIG. 6). Gripper arms 152*a* and 152*b* include hubs 380*a*, 380*b*, grip supports 382*a*, 382*b*, grips 384*a*, 384*b*, bell cranks 386*a*, 386*b* and pins 388*a*, 388*b*, respectively. Hubs 380*a*, 380*b* rotatably support arms 152*a* and 152*b* about spindles 358*a* and 358*b*, respectively. Each hub 380 is a generally cylindrical shaped member having a slot 390*a*, 390*b* for fixedly receiving an end of gripper supports 382. Each slot 390*a*, 390*b* is preferably configured so as to have a keyed relationship with respect to its corresponding grip support 382*a*, 382*b* to prevent relative movement between hub 380*a*, 380*b* and the grip support 382*b*. As shown by FIG. 7, hub 380*a* is rotatably supported about spindle 358*a* between hub mounts 354*a* and 355*b* and between platforms 364 and 368. Hub 380*b* is rotatably supported about spindle 358*b* between hub mounts 356*b* and 357*b* and between platforms 366 and 368.

Grip supports 382*a*, 382*b* are generally elongate rigid bars configured and shaped for wrapping about an engaging refuse receptacle. Each grip support 382*a*, 382*b* preferably has a concave surface facing a corresponding concave surface of the other grip support. Grip supports 382*a*, 382*b* support grips 384*a*, 384*b*, respectively. Grips 384*a*, 384*b* are preferably formed from resilient and relatively compressible material having high coefficients of friction, such as rubber. Grips 384*a*, 384*b* preferably have a sufficient surface area for grabbing or gripping the refuse receptacle and prevent an engaged refuse receptacle from moving with respect to arms 152*a* and 152*b*.

Bell cranks 386*a*, 386*b* each comprise a pair of flat opposing plates for supporting pins 388*a*, 388*b*, respectively. Pins 388*a*, 388*b* are pivotally coupled to an extendable and retractable end of actuators 154*a*, 154*b*, respectively.

Actuators 154*a*, 154*b* rotate arms 152*a*, 152*b* about the axes of spindles 358*a* and 358*b* to selectively engage and release refuse receptacles. Actuators 154*a*, 154*b* are preferably linear actuators for imparting linear movement to pins 388*a*, 388*b* and bell cranks 386*a*, 386*b* to correspondingly rotate or pivot arms 152*a* and 152*b* to move arms 152*a* and 152*b* together or away from one another for engaging or releasing a refuse receptacle. Actuator 154*a* has a first end stationarily coupled to pin 353*b* and a second end coupled to pin 388*a*. As a result, extension and retraction of actuator 154*a* rotates grip support 382*a* and grip 384*a* about spindle 358*a*. Similarly, actuator 154*b* has an end stationarily coupled to pin 353*b* and a second end coupled to pin 388*b*. As a result, extension and retraction of actuator 154*b* rotates grip support 382*a* and grip 384*b* about spindle 358*b*. Actuators 154*a*, 154*b* preferably comprise hydraulic cylinder assemblies as are conventionally known. Alternatively, actuators 154*a*, 154*b* may comprise anyone of a variety of linear actuators for selectively imparting linear motion such as solenoids, rack and pinion arrangements, pneumatic cylinder assemblies and the like. Moreover, in lieu of using a linear actuator in conjunction with a bell crank to rotate or pivot arms 152*a* and 152*b*, arms 152*a* and 152*b* may alternatively utilize any one of a variety of well-known rotational actuators such as hydraulic rotary actuators, rack and pinion arrangements and the like.

Figure 8:
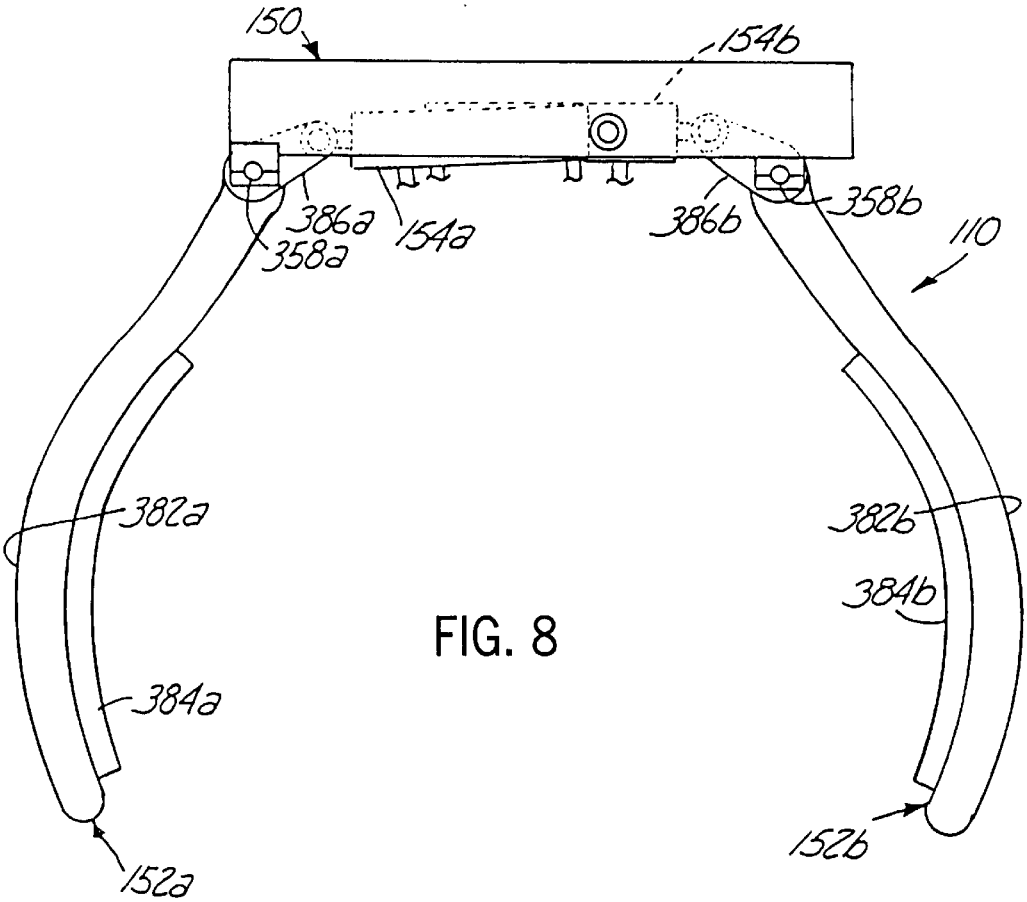
FIG. 8 is a top elevational view of the receptacle engaging assembly having arms in an opened position.
Figure 9:
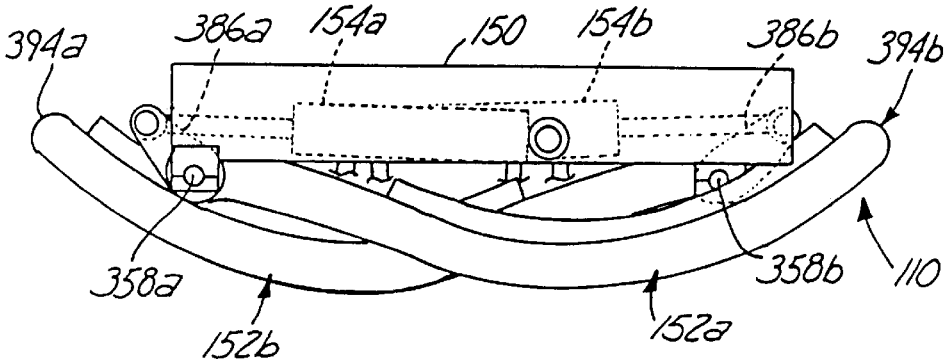
FIG. 9 is a top elevational view of the receptacle engaging assembly having arms in a closed, folded position.

FIGS. 8 and 9 are top elevational views of receptacle engaging assembly 110 illustrating arms 152*a* and 152*b* in an opened position for engaging or releasing a refuse receptacle and in a closed, folded position for compact positioning when not in use. As best shown by FIGS. 8 and 9, actuators 154*a* and 154*b* may be actuated to selectively pivot or rotate arms 152*a* and 152*b* in a generally horizontal plane in front of support 150. As shown by FIG. 8, arms 152*a* and 152*b* pivot about spindles 358*a* and 358*b*, respectively to form a C-shaped receptacle gripping device for substantially surrounding and encircling a refuse receptacle to engage at least three sides of the receptacle. In addition, actuators 154*a* and 154*b* may be selectively extended or retracted to reduce or enlarge the spacing between arms 152*a* and 152*b* for engaging and releasing a variety of refuse receptacles having different shapes and different dimensions. Arms 154*a* and 154*b* may also be independently extended or retracted to engage differently shaped refuse receptacles.

As shown by FIG. 9, in the preferred embodiment illustrated, the extension of actuator 154*a* moves bell crank 386*a* outward to pivot arm 152*a* in a generally counterclockwise direction about spindle 358*a*. Extension of actuator 154*b* moves bell crank 386*b* outward to pivot arm 152*b* in a generally clockwise direction about spindle 358*b*. Because arm 152*a* and arm 152*b* are vertically spaced from one another and are free to rotate or pivot to a position substantially parallel with support 150, arms 152*a* and 152*b* of receptacle engaging assembly 110 may be folded or interleaved across one another so that both arms 152*a* and 152*b* extend substantially adjacent and parallel to support 150 for compact storage as the refuse collection vehicle 10 moves from site to site. Arms 152*a* and 152*b* may be pivoted or rotated towards one another and actually past one another until ends 394*a* and 394*b* of arms 152*a* and 152*b*, respectively, extend behind spindles 358*a* and 358*b* and behind a front surface of support 150. Thus, receptacle engaging assembly 110 may be actuated to completely fold arms 152*a* and 152*b* adjacent to support 150 to minimize the extent at which arms 152*a* and 152*b* project from support 150. As a result, arms 152*a* and 152*b* are less likely to catch upon roadside obstructions and do not themselves obstruct an operator's view as the refuse collection vehicle is driven up to a refuse receptacle.

VI. OPERATION OF REFUSE RECEPTACLE COLLECTION ASSEMBLY

Figure 10:
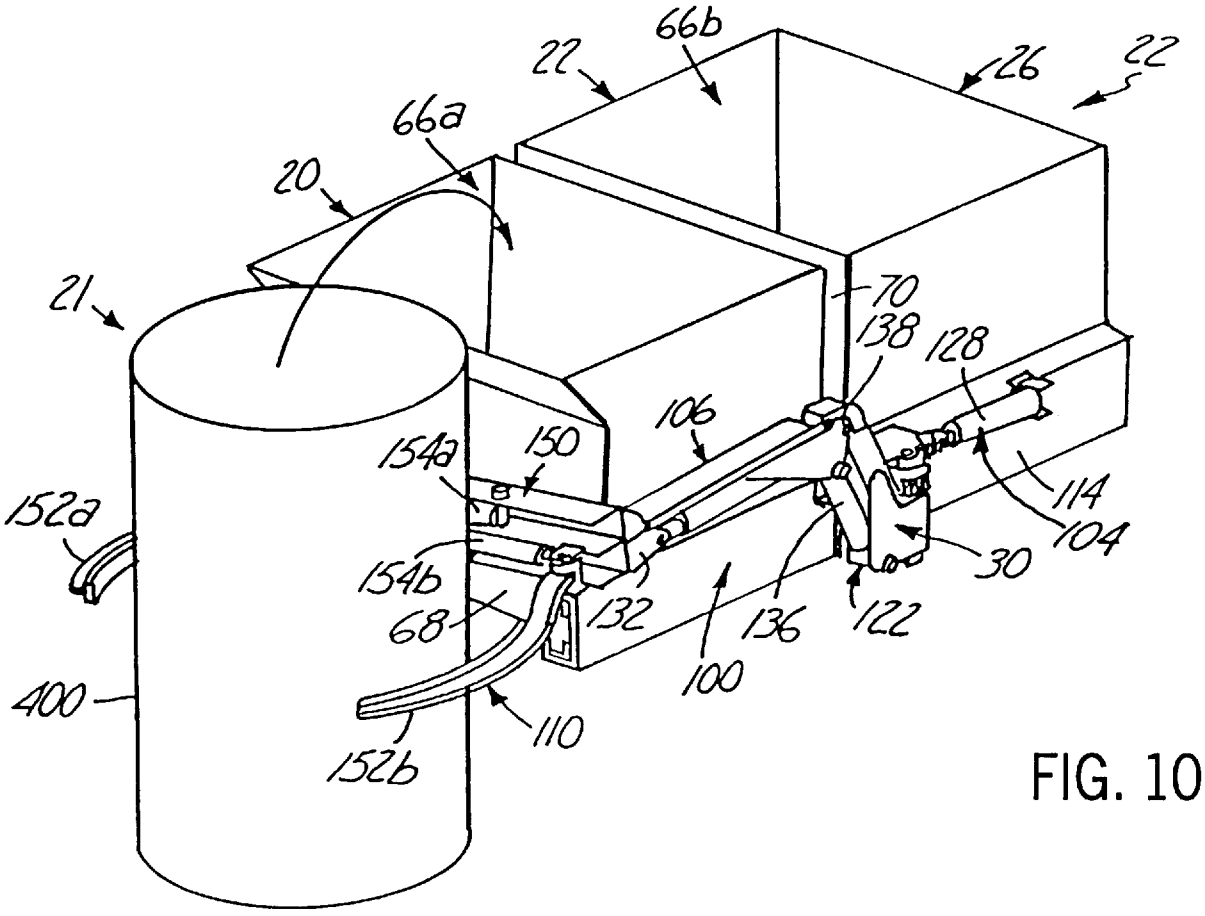
FIG. 10 is a perspective view illustrating the refuse receptacle collection assembly selectively moved so as to engage a refuse receptacle located curbside with respect to the intermediate container.
Figure 11:
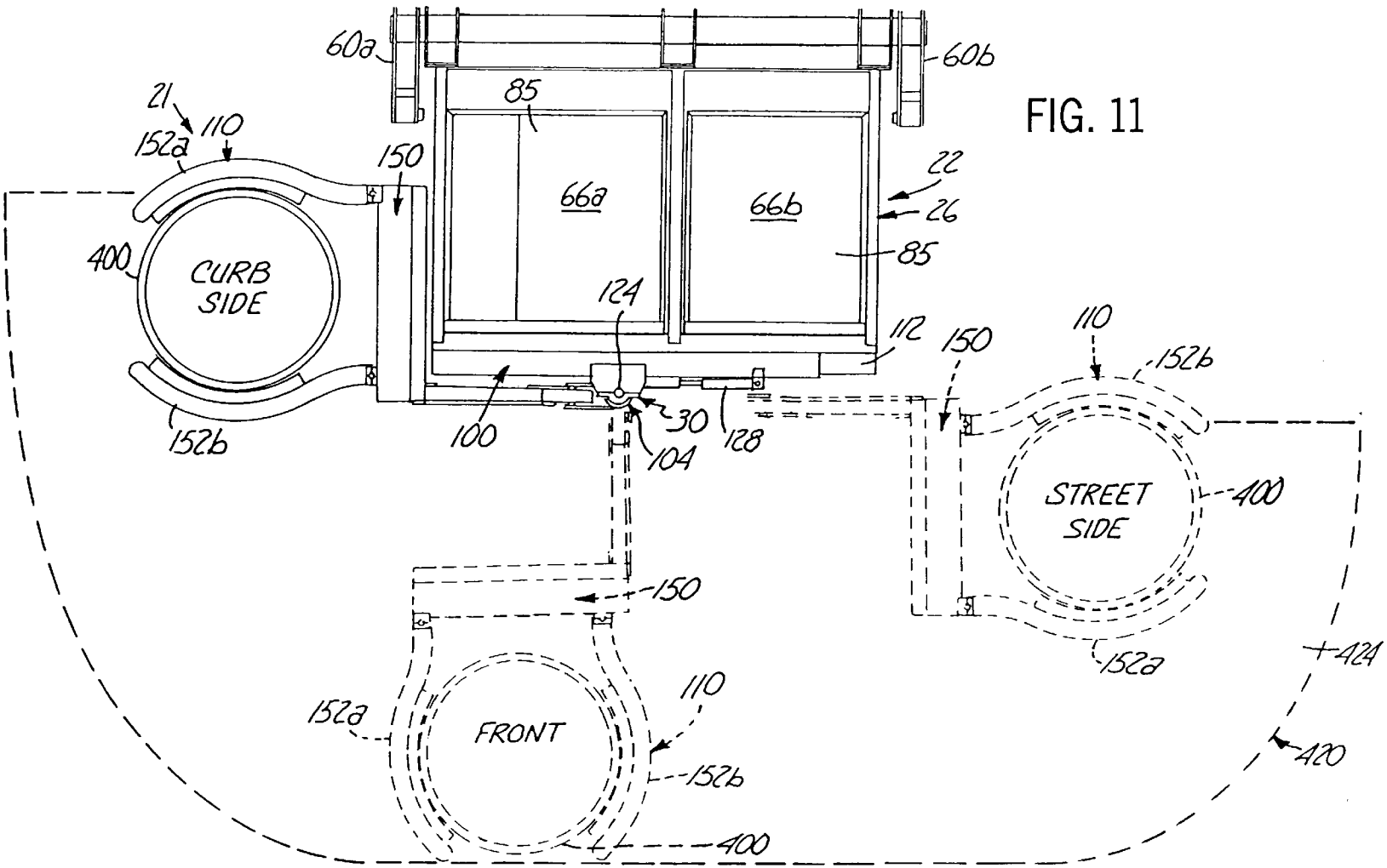
FIG. 11 is a top elevational view of a horizontal range of motion of the refuse receptacle collection assembly.

FIGS. 10–14 illustrate refuse receptacle collection assembly 30 selectively moved so as to engage a refuse receptacle 400 in various locations with respect to intermediate container 26 and selectively moved so as to selectively dump contents of refuse receptacle 400 into a selected bin 66 of intermediate container 26. In particular, FIGS. 10 and 11 illustrate refuse receptacle collection assembly 30 engaging refuse receptacle 400 curbside, streetside and in front of intermediate container 26. FIG. 10 is a perspective view of intermediate container 26 and collection assembly 30 illustrating refuse receptacle collection assembly 30 positioned for engaging refuse receptacle 400 located on the curbside 21 of intermediate container 26. As shown by FIG. 10, actuator 136 of dumping assembly 106 is actuated to lift or rotate arm 130 clockwise about pin 138 to raise kicker 132 and receptacle engaging assembly 110 off of carrier 68. Actuator 128 of pivot assembly 104 is selectively actuated to rotate boom assembly 122 to align gripper arms 152*a* and 152*b* of receptacle engaging assembly 110 on opposite sides of refuse receptacle 400. Actuator assembly 116 (shown in FIG. 4) of carriage assembly 100 is actuated to move carriage 114 on track 112 towards the curbside 21 of intermediate container 26. Carriage 114 is moved towards the curbside 21 of intermediate container 26 until arms 152*a* and 152*b* are positioned on opposite sides of refuse receptacle 400. Actuators 154*a* and 154*b* of receptacle engaging assembly 110 are then selectively actuated so as to move arms 152*a* and 152*b* towards one another for engaging refuse receptacle 400. As shown by FIG. 10, refuse receptacle collection assembly 30 is capable of engaging refuse receptacles positioned curbside 21 without manual assistance.

FIG. 11 is a top plan view of intermediate container 26 and of receptacle collection assembly 30 illustrating a range-of-motion of receptacle engaging assembly 110 of receptacle collection assembly 30. As shown by FIGS. 10 and 11, receptacle collection assembly 30 is preferably configured for positioning receptacle engaging assembly 110 curbside 21 for engaging a refuse receptacle 400 located curbside with respect to intermediate container 26. As further shown in phantom in FIG. 11, receptacle collection assembly 30 is also configured for positioning and supporting receptacle engaging assembly 110 streetside 22 for engaging a refuse receptacle 400 positioned streetside with respect to intermediate container 26 and forward of intermediate container 26 for engaging a refuse receptacle 400 located in front of intermediate container 26. For example, to engage a refuse receptacle 400 positioned forward of intermediate container 26, arms 152*a* and 152*b* of receptacle engaging assembly 110 are aligned with refuse receptacle 400 in front of intermediate container 26 by selectively moving carriage 114 along track 112 to a desired position in front of intermediate container 26. Actuator 128 of pivot assembly 104 is selectively actuated to pivot or rotate arms 152*a* and 152*b* of receptacle engaging assembly 110 in a substantially horizontal plane in front of intermediate container 26. If needed, once aligned, refuse collection vehicle 20 may be driven forward until refuse receptacle 400 is positioned between arms 152*a* and 152*b* of receptacle engaging assembly 110. Actuators 154*a* and 154*b* (shown in FIGS. 7–9) of receptacle engaging assembly 110 may then be selectively actuated so as to move arms 152*a* and 152*b* towards one another for engaging or gripping receptacle 400.

Alternatively, to engage a refuse receptacle 400 located streetside 22 with respect to intermediate container 26, actuator 128 of pivot assembly 104 is selectively actuated so as to pivot receptacle engaging assembly 110 in a substantially horizontal plane so as to align arms 152*a* and 152*b* of receptacle engaging assembly 110 with refuse receptacle 400 located streetside 22. Actuator assembly 116 (shown in FIG. 4) of carriage assembly 100 is selectively actuated to extend carriage 114 outward away from intermediate container 26 towards the streetside 22 and to also move arms 152*a* and 152*b* towards streetside and preferably about refuse receptacle 400. Once arms 152*a* and 152*b* are positioned about refuse receptacle 400, selective actuation of actuators 154*a* and 154*b* (shown in FIGS. 7–9) of receptacle engaging assembly 110 moves arms 152*a* and 152*b* towards one another to engage refuse receptacle 400.

FIG. 11 further illustrates receptacle horizontal engaging range 420. Range 420 (outlined by dashed lines) defines a range-of-motion provided to receptacle engaging assembly 110 by refuse receptacle collection assembly 30. In particular, carriage assembly 100 and pivot assembly 104 of receptacle collection assembly 30 provide range 420 to receptacle engaging assembly 110. This range-of-motion enables refuse receptacle engaging assembly 110 to engage and collect refuse receptacles 400 located substantially anywhere within range 420 by selective actuation and movement of carriage assembly 100 and pivot assembly 104. Because pivot assembly 104 may be selectively actuated to horizontally pivot receptacle engaging assembly 110 about an axis of spindle 124 approximately 180°, receptacle engaging assembly 110 may be positioned for engaging a receptacle 400 positioned substantially anywhere along a 180° or greater arc centered at an axis of spindle 124. Furthermore, because carriage 114 of carriage assembly 100 may be selectively moved along track 112 to move receptacle engaging assembly 110 and spindle 124 between curbside 21 and streetside 22, the axis of spindle 124 about which receptacle engaging assembly 110 pivots is also movable between curbside 21 and streetside 22. Thus, receptacle engaging assembly 110 may be positioned by receptacle collection assembly 30 for engaging a receptacle 400 along substantially an entire frontal area of intermediate container 26, including portions of range 420 immediately forward and adjacent carriage 114 in front of intermediate container 26. Moreover, because carriage 114 is generally bi-directional along track 112, receptacle engaging assembly 110 is extendable beyond track 112 both curbside 21 and streetside 22. As a result, receptacle collection assembly 30 may selectively move receptacle engaging assembly 110 farther outward away from intermediate container 26. Thus, as shown by range 420, refuse receptacle collection assembly 30 may be selectively moved so as to position receptacle engaging assembly 110 in any one of a variety of positions for engaging a refuse receptacle 400 positioned curbside 21, streetside 22 or in front of intermediate container 26.

Figure 12:
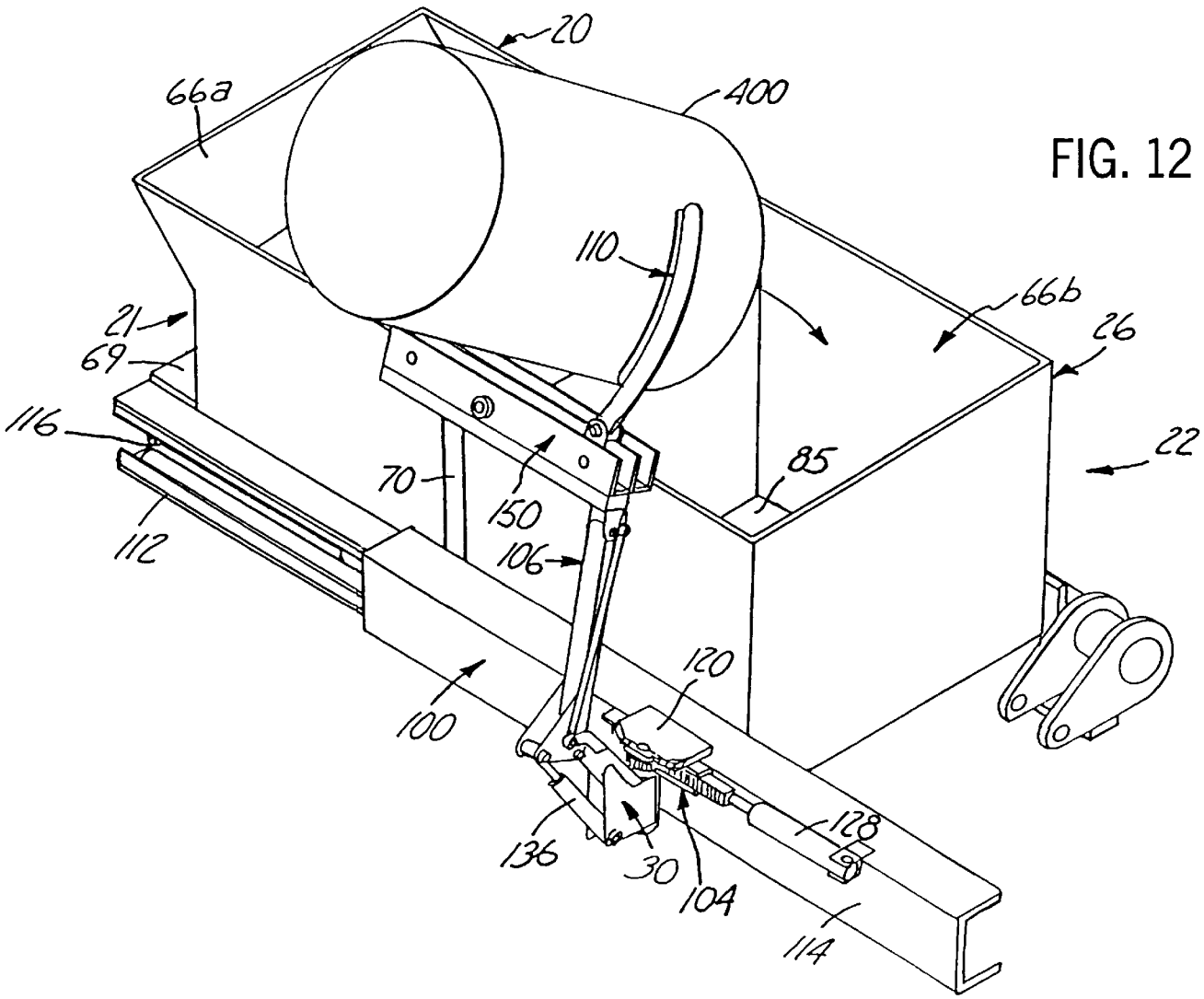
FIG. 12 is a perspective view illustrating the refuse receptacle collection assembly selectively moved so as to dump contents of an engaged refuse receptacle into a first bin of the intermediate container from a position forward the intermediate container.
Figure 13:
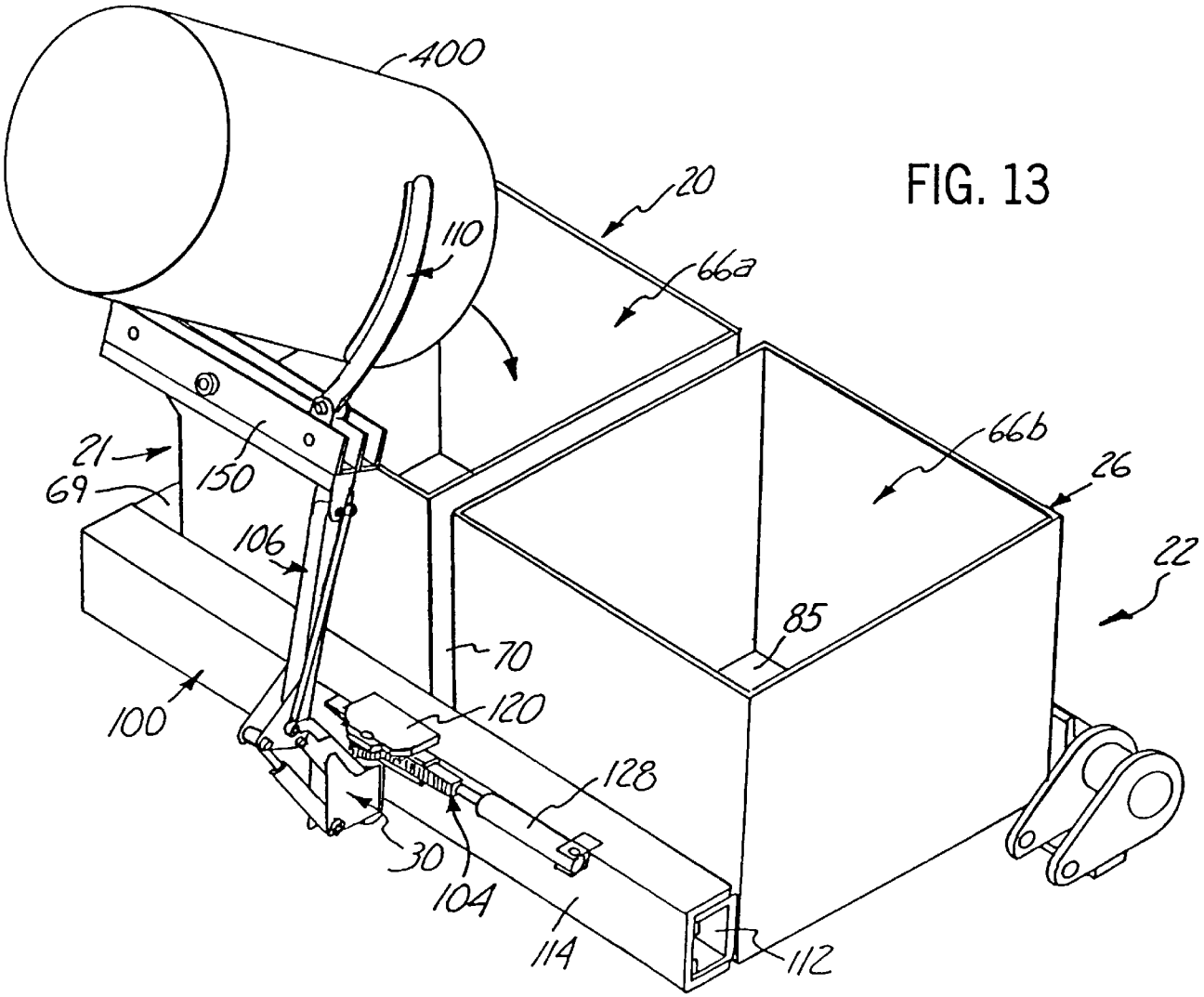
FIG. 13 is a perspective view of the refuse receptacle collection assembly selectively moved so as to dump contents of an engaged refuse receptacle into a second bin of the intermediate container from a position forward the intermediate container.
Figure 14:
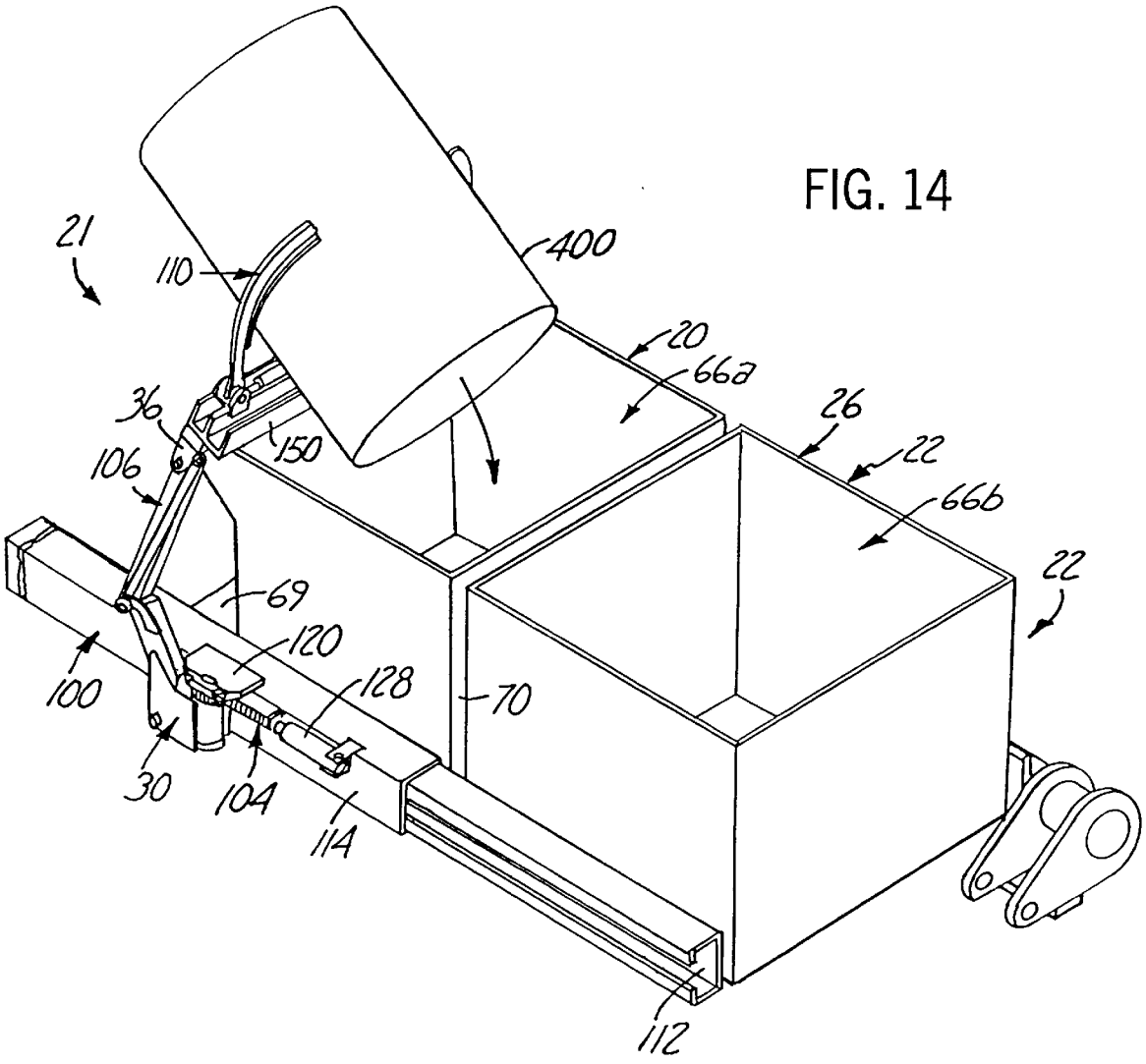
FIG. 14 is a perspective view of the refuse receptacle collection assembly selectively moved so as to dump contents of an engaged refuse receptacle into a first bin of the intermediate container from a position curbside with respect to the intermediate container.

FIGS. 12–14 illustrate refuse receptacle collection assembly 30 selectively dumping contents of refuse receptacle 400 into a selected one of bins 66*a*, 66*b* of intermediate container 26. FIG. 12 illustrates refuse receptacle collection assembly 30 dumping the contents of receptacle 400 into bin 66*b* of intermediate container 26. As shown by FIG. 12, once refuse receptacle 400 is engaged by receptacle engaging assembly 110, refuse receptacle 400 is preferably lifted off of the ground by selective actuation of actuator 136 of receptacle dumping assembly 106. To align and position refuse receptacle 400 with bin 66*b*, actuator assembly 116 is selectively actuated to move carriage 114 along track 112 so as to position refuse receptacle 400 engaged by receptacle engaging assembly 110 in alignment with bin 66*b*. If necessary, actuator 128 of pivot assembly 104 may be actuated to rotate or pivot refuse receptacle 400 in a generally horizontal plane with respect to intermediate container 26 for further alignment of refuse receptacle 400 with bin 66*b*. Once receptacle 400 is properly aligned with bin 66*b* of intermediate container 26, actuator 136 of dumping assembly 106 is selectively actuated to rotate arm 130, receptacle engaging assembly 110 and refuse receptacle 400 in a generally vertical plane until receptacle 400 is tilted and unloaded into bin 66*b*. Once the contents of receptacle 400 are unloaded into bin 66*b*, receptacle 400 may be returned to its initial position or a new position on the ground by selective movement of carriage assembly 100 and pivot assembly 104. Receptacle 400 may then be lowered or raised and placed upon a surface by selective movement of dumping assembly 106. Lastly, selective actuation of receptacle engaging assembly 110 may be performed to move arms 152*a* and 152*b* (shown in FIG. 10) away from one another for releasing receptacle 400.

FIG. 13 illustrates refuse receptacle collection assembly 30 positioned for unloading contents of refuse receptacle 400 into bin 66*a* of intermediate container 26. Once receptacle 400 has been engaged by receptacle engaging assembly 110, dumping assembly 106 is selectively moved to raise receptacle 400 off of the ground or surface. Receptacle 400 is then aligned with bin 66*a* by selective movement of carriage 114 and by selective rotation of pivot assembly 104. Once receptacle 400 is aligned with bin 66*a*, dumping assembly 106 is actuated to lift, raise and tilt receptacle 400 so as to unload the contents of receptacle 400 into bin 66*a*. As discussed above, once the contents of receptacle 400 have been unloaded into bin 66*a*, receptacle 400 may be repositioned at the previous location or at a new location as desired by selective movement of carriage 114 and pivot assembly 104. Dumping assembly 106 is once again moved so as to rest receptacle 400 on the ground or another surface.

Receptacle engaging assembly 110 is selectively actuated to move arms 152*a*, 152*b* (shown in FIG. 10) away from one another for releasing receptacle 400.

FIG. 14 illustrates the unloading of receptacle 400 into bin 66*a* directly from the curbside 21. Once receptacle 400 located curbside 21 is engaged by receptacle engaging assembly 110, dumping assembly 106 may be selectively actuated so as to directly raise and tilt receptacle 400 into bin 66*a*. Because kicker 36 extends substantially parallel to curbside 21 of intermediate container 26, rotation of receptacle 400 by pivot assembly 104 to align receptacle 400 with bin 66*a* is minimized or eliminated. As a result, unloading contents of receptacle 400 into bin 66*a* is simplified and performed in less time.

V. CONCLUSION

Refuse collection vehicle 20 enables an operator to quickly and efficiently collect and segregate refuse contained in receptacles without extensive manual or physical labor. In particular, by selective control of refuse receptacle collection assembly 30, an operator may collect refuse receptacle in a multitude of locations with respect to the refuse collection vehicle. For example, by selective movement of carriage assembly 100, the operator may collect refuse receptacles adjacent or farther away from either the curbside or streetside of intermediate container 26. By selective movement of pivot assembly 104, the operator may collect refuse receptacles located anywhere within the 180 degree arc of pivot assembly 104. By selectively moving both carriage assembly 100 and pivot assembly 104, the operator can collect refuse receptacles in even a larger area with respect to the refuse collection vehicle. Furthermore, by selective movement of dumping assembly 106, the operator may collect refuse receptacles supported and stored at different horizontal levels by raising and lowering the receptacle engaging assembly 110.

Once a refuse receptacle has been engaged by receptacle engaging assembly 110, unloading the receptacle into intermediate container 26 is easily completed by selective actuation of dumping assembly 106. If intermediate container 26 is divided into a plurality of bins 66 for segregating refuse types, the operator may selectively dump contents of the refuse receptacle into a selected one of the plurality of bins by selective movement of carriage assembly 100 and pivot assembly 104. As a result, engaging a refuse receptacle and unloading the refuse receptacle into a selected bin may be easily performed without the necessity of the operator leaving the cab of the refuse collection vehicle.

Once the contents of the refuse receptacle have been unloaded into intermediate container 26, the operator may selectively reposition the empty refuse receptacle at the previous position or at a new position by selective movement of carriage assembly 100 and pivot assembly 104. After the refuse receptacle has been lowered and released by selective actuation of dumping assembly 106 and receptacle engaging assembly 110, refuse collection assembly 30 may be compactly stored adjacent intermediate container 26 to avoid obstruction of the operator's view while unloading intermediate container 26 into refuse collection vehicle and while driving refuse collection vehicle 20. In particular, gripper arms 152*a* and 152*b* may be easily folded and interleaved adjacent to support 150 for compact storage. Dumping assembly 106 may be pivoted by pivot assembly 104 so as to position arm 130 adjacent to bin 66*a* and so as to position kicker 132 and receptacle engaging assembly 110 adjacent landing 69. As a result, receptacle collection assembly 30 is stably supported when not in use and does not interfere with the unloading of intermediate container 26 into the storage body of refuse collection vehicle 20 and with the driving of refuse collection vehicle 20 to a new collection site.

As can be appreciated, refuse collection assembly 30 may be used with a variety of refuse collection vehicles. For example, refuse collection assembly 30 may alternatively be used with an intermediate container having a single bin or three or more bins. Refuse receptacle collection assembly 30 may alternatively be mounted to an intermediate container located adjacent a side of the refuse collection vehicle or at a rear of the refuse collection vehicle.

Furthermore, as can be appreciated, refuse collection assembly 30 may have a variety of alternative configurations. For example, refuse receptacle collection assembly 30 may also be oppositely configured for extending around and parallel to streetside 22 of intermediate container 26. Carriage assembly 100, pivot assembly 104, receptacle dumping assembly 106 and receptacle engaging assembly 110 may each individually have any one of a variety of well-known equivalent mechanical and structural configurations to provide the same function with the same particular range-of-motion. For example, receptacle engaging assembly 110 may also alternatively utilize any one of a variety of well-known assemblies configured for engaging a variety of refuse receptacles such as those including multiple opposing gripper arms. In addition, the individual functions performed by these assemblies may be formed by a single structure.

Although the present invention has been described with reference to preferred embodiments, workers skilled in the art will recognize that changes may be made in form and detail without departing from the spirit and scope of the invention.

What is claimed is:

1. A refuse collection vehicle for collecting refuse contained in refuse receptacles, the vehicle comprising:

a storage body having a plurality of segregated refuse compartments;

an intermediate container having a plurality of bins corresponding to the plurality of refuse compartments;

an intermediate container dumping assembly supported proximate the storage body for lifting and emptying contents of each of the plurality of bins into corresponding refuse compartments of the storage body; and a refuse receptacle collection assembly supported adjacent the plurality of bins of the intermediate container, wherein the refuse receptacle collection assembly is configured for engaging a refuse receptacle, wherein the refuse receptacle collection assembly is selectively movable so as to selectively dump contents of the refuse receptacle into a selected one of the plurality of bins, wherein the refuse receptacle collection assembly includes:

a track supported by the intermediate container proximate to each of the plurality of bins;

a carriage movable along the track;

a receptacle engaging assembly supported by the carriage for engaging the refuse receptacle; and a receptacle dumping assembly supported by the carriage for dumping the refuse receptacle engaged by the receptacle engaging assembly into the selected one of the plurality of bins.

2. The refuse collection vehicle of claim 1 wherein a first one of the plurality of bins is positioned adjacent a first side of the intermediate container, a second one of a plurality of bins is positioned adjacent a second opposite side of the intermediate container, and wherein the track extends from the first side to the second side and wherein the carriage moves along the track from the first side to the second side.

3. The refuse collection vehicle of claim 1 wherein the refuse receptacle collection assembly includes:

a pivot assembly supported proximate the intermediate container for pivoting the receptacle engaging assembly and the receptacle dumping assembly to selectively dump contents of the engaged refuse receptacle into a selected one of the plurality of bins.

4. The refuse collection vehicle of claim 3 wherein the pivot assembly horizontally pivots the receptacle engaging assembly approximately 180 degrees to enable the receptacle engaging assembly to engage refuse receptacles adjacent a first side, a second opposite side and between the first and second opposite sides of the refuse collection vehicle.

5. The refuse collection vehicle of claim 3 wherein the pivot assembly includes:

a spur gear coupled to the receptacle engaging assembly and the receptacle dumping assembly;

a rack gear slidably supported in engagement with the spur gear; and means for selectively moving the rack gear so as to selectively rotate the spur gear to pivot the receptacle engaging assembly and the receptacle dumping assembly.

6. The refuse collection vehicle of claim 1 wherein the carriage is bi-directionally movable along the track so that the receptacle engaging assembly and the receptacle dumping assembly may be moved proximate to opposite sides of the intermediate container.

7. The refuse collection vehicle of claim 6 wherein the carriage assembly includes a pair of oppositely directed linear actuators coupled between the track and the carriage.

8. The refuse collection vehicle of claim 1 wherein the receptacle engaging assembly includes:

a support coupled to the receptacle dumping assembly;

a first gripper arm pivotally coupled to a front of the support proximate a first end of the support;

a second gripper arm pivotally coupled to the front of the support proximate a second opposite end of the support, wherein the second gripper arm is vertically spaced from the first gripper arm so that the first gripper arm and the second gripper arm may be pivoted adjacent and parallel to the support for compact storage; and means for selectively pivoting the first and second gripper arms.

9. A refuse collection vehicle for collecting refuse contained in refuse receptacles, the vehicle comprising:

a storage body;

at least one support arm extending forward of the storage body for lifting and emptying refuse into the storage body;

an intermediate container supported by said at least one support arm; and a refuse receptacle collection assembly, the assembly including:

a carriage assembly adjacent the intermediate container, the carriage assembly including:

a track supported by the intermediate container and extending along a front side of the intermediate container;

a carriage slidably supported along the track; and a linear actuator assembly for selectively moving the carriage along the track;

a receptacle engaging assembly configured for engaging the refuse receptacle;

a dumping assembly coupled to the receptacle engaging assembly for raising and dumping contents of the engaged refuse receptacle into the intermediate container; and a pivot assembly supporting the dumping assembly and rotatably coupled to the carriage.

10. The refuse collection vehicle of claim 9, wherein the storage body includes a plurality of segregated refuse compartments and wherein the intermediate container includes a plurality of bins corresponding to the plurality of refuse compartments.

11. The refuse collection vehicle of claim 9, wherein the pivot assembly is configured to rotate the receptacle engaging assembly between a first position in which the engaging assembly faces a first side of the intermediate container for engaging receptacles located on the first side of the intermediate container and a second position in which the engaging assembly faces a second side of the intermediate container for engaging receptacles located on the second side of the intermediate container.

12. The refuse collection vehicle of claim 11, wherein the pivot assembly is configured to rotate the receptacle engaging assembly approximately 180 degrees in a substantially horizontal plane.

13. A refuse collection vehicle for collecting refuse contained in refuse receptacles, the vehicle comprising:

a storage body having a plurality of segregated refuse compartments;

an intermediate container having a plurality of bins corresponding to the plurality of refuse compartments;

an intermediate container dumping assembly supported proximate the storage body for lifting and emptying contents of each of the plurality of bins into corresponding refuse compartments of the storage body; and a refuse receptacle collection assembly supported adjacent the plurality of bins of the intermediate container, wherein the refuse receptacle collection assembly is configured for engaging a refuse receptacle, wherein the refuse receptacle collection assembly is selectively movable so as to selectively dump contents of the refuse receptacle into a selected one of the plurality of bins, wherein the refuse receptacle collection assembly includes:

a track supported across a front side of the plurality of bins;

a carriage movable along the track so that the carriage is moveable along a front side of each of the plurality of bins;

a receptacle engaging assembly supported by the carriage for engaging the refuse receptacle; and a receptacle dumping assembly supported by the carriage for dumping the refuse receptacle engaged by the receptacle engaging assembly into the selected one of the plurality of bins.

14. The refuse collection vehicle of claim 13 wherein the track is supported by the intermediate container.

15. The refuse collection vehicle of claim 13, including:

repositioning means coupled to the receptacle engaging assembly for selectively repositioning the engaging assembly so that the engaging assembly may be moved between a first position in which the engaging assembly faces a first side of the intermediate container for engaging receptacles located on the first side of the intermediate container and a second position in which the engaging assembly faces a second opposite side of the intermediate container for engaging receptacles located on the second opposite side of the intermediate container.

16. The refuse collection vehicle of claim 15, wherein the repositioning means rotates the receptacle engaging assembly approximately 180 degrees to move the receptacle engaging assembly between the first and second positions.

17. The refuse collection vehicle of claim 16, wherein the repositioning means rotates the receptacle engaging assembly approximately 180 degrees in a substantially horizontal plane.

18. The refuse collection vehicle of claim 13, including:

a support coupled to the carriage; and a pivot assembly including a pivot arm pivotally coupled to the support at a first end and supporting the receptacle engaging assembly at a second end.

19. The refuse collection vehicle of claim 18, wherein the pivot assembly includes:

an actuator for selectively pivoting the pivot arm.

20. A refuse collection vehicle for collecting refuse contained in refuse receptacles, the vehicle comprising:

a storage body having a plurality of segregated refuse compartments;

an intermediate container having a plurality of bins corresponding to the plurality of refuse compartments;

an intermediate container dumping assembly supported proximate the storage body for lifting and emptying contents of each of the plurality of bins into corresponding refuse compartments of the storage body; and a refuse receptacle collection assembly supported adjacent the plurality of bins of the intermediate container, wherein the refuse receptacle collection assembly is configured for engaging a refuse receptacle, wherein the refuse receptacle collection assembly is selectively movable so as to selectively dump contents of the refuse receptacle into a selected one of the plurality of bins, wherein the refuse receptacle collection assembly includes:

a track proximate to each of the plurality of bins;

a carriage movable along the track;

a receptacle dumping assembly supported by the carriage; and a receptacle engaging assembly including:

a support coupled to the receptacle dumping assembly;

a first gripper arm pivotally coupled to a front of the support proximate a first end of the support;

a second gripper arm pivotally coupled to the front of the support proximate a second opposite end of the support, wherein the second gripper arm is vertically spaced from the first gripper arm so that the first gripper arm and the second gripper arm may be pivoted adjacent and parallel to the support for compact storage; and means for selectively pivoting the first and second gripper arms.

* * * * *